US011059620B2

(12) United States Patent
Greer

(10) Patent No.: US 11,059,620 B2
(45) Date of Patent: Jul. 13, 2021

(54) CONTAINER CONSTRUCTION

(71) Applicant: SUB ZERO INTERNATIONAL LIMITED, Hamilton (NZ)

(72) Inventor: Alexander Townshend Greer, Hamilton (NZ)

(73) Assignee: SUB ZERO INTERNATIONAL LIMITED, Hamilton (NZ)

( * ) Notice: Subject to any disclaimer, the term of this patent is extended or adjusted under 35 U.S.C. 154(b) by 0 days.

(21) Appl. No.: 16/967,626

(22) PCT Filed: Feb. 5, 2019

(86) PCT No.: PCT/NZ2019/050009
§ 371 (c)(1),
(2) Date: Aug. 5, 2020

(87) PCT Pub. No.: WO2019/156574
PCT Pub. Date: Aug. 15, 2019

(65) Prior Publication Data

US 2020/0391899 A1 Dec. 17, 2020

(30) Foreign Application Priority Data

Feb. 6, 2018 (NZ) ..... 736975

(51) Int. Cl.
*B65D 1/04* (2006.01)
*A45F 3/16* (2006.01)
(Continued)

(52) U.S. Cl.
CPC ..... *B65D 1/04* (2013.01); *A45F 3/16* (2013.01); *B65D 1/0207* (2013.01);
(Continued)

(58) Field of Classification Search
CPC ..... A45F 3/16; B65D 1/0207; B65D 1/02; B65D 1/0223; B65D 81/3205;
(Continued)

(56) References Cited

U.S. PATENT DOCUMENTS 6,112,537 A 9/2000 Broadbent
6,276,163 B1 8/2001 Broadbent
(Continued)

FOREIGN PATENT DOCUMENTS

WO 2014062071 A1 4/2014
WO 2015160266 A1 10/2015

OTHER PUBLICATIONS

International Search Report & Written Opinion for PCT/NZ2019/050009, dated May 13, 2019.
(Continued)

*Primary Examiner* — Robert J Hicks
(74) *Attorney, Agent, or Firm* — Pilloff Passino & Cosenza LLP; Martin J. Cosenza

(57) ABSTRACT

The invention is a bottle or container for a beverage, which is configured with an upper and lower compartment connected by a waist portion that defines a passage therebetween. Through the use of an appropriately configured freezing shelf, the beverage held in the lower compartment can be frozen at point of sale. The bottle is specifically configured to, upon activation, create a pinch point between the waist portion of the bottle and the punt of the lower compartment. This pinch point is achieved through controlled deformation of part of the lower compartment and/or waist portion of the bottle and effectively seals the lower compartment, and its contents, from the upper compartment, or at the very least significantly restricts the passage between the two compartments. Convection circulation between the two compartments is prevented or at least hindered. The
(Continued)

isolation of the lower compartment from the upper compartment by virtue of the pinch point may leads to quicker crystallization and ice formation. The invention is advantageous it means that the beverage contained in the upper compartment can be held at a higher temperature and thus is easier to consume at the time of purchase and allowing some time for the beverage in the lower compartment to melt and in due course become consumable.

30 Claims, 19 Drawing Sheets

(51) Int. Cl.

| | |
|---|---|
| ***B65D 1/02*** | (2006.01) |
| ***B65D 81/32*** | (2006.01) |
| ***F25D 31/00*** | (2006.01) |
| ***F25D 3/08*** | (2006.01) |

(52) U.S. Cl.
CPC ..... *B65D 1/0223* (2013.01); *B65D 81/32* (2013.01); *F25D 3/08* (2013.01); *F25D 31/00* (2013.01); *F25D 31/007* (2013.01); *F25D 2303/0845* (2013.01); *F25D 2331/803* (2013.01)

(58) Field of Classification Search
CPC ... B65D 81/32; F25D 3/08; F25D 3/06; F25D 31/00; F25D 31/007
USPC ..... 215/6, 376; 220/503, 502, 501, 666
See application file for complete search history.

(56) References Cited

U.S. PATENT DOCUMENTS

| | | | | |
|---|---|---|---|---|
| 7,882,972 | B2 * | 2/2011 | Inomata | B65D 1/0223 215/381 |
| 8,028,498 | B2 * | 10/2011 | Melrose | B65D 1/0276 53/281 |
| 8,733,578 | B2 * | 5/2014 | Michaels | A47G 19/2205 220/531 |
| 2004/0112904 | A1 | 6/2004 | Kurs | |
| 2013/0247591 | A1 * | 9/2013 | DeMasi | A61J 9/02 62/4 |
| 2015/0223632 | A1 * | 8/2015 | Hall | B65D 85/804 99/295 |

OTHER PUBLICATIONS

International Preliminary Report on Patentability for PCT/NZ2019/050009, dated Nov. 14, 2019.

* cited by examiner

CONTAINER CONSTRUCTION

STATEMENT OF CORRESPONDING APPLICATIONS

This application is based on the Provisional specification filed in relation to New Zealand Patent Application No. 736975 filed on 6 Feb. 2018, the entire contents of which are incorporated herein by reference.

TECHNICAL FIELD

The present invention relates to the construction of a container. The invention has particular application to bottles for beverages to be directly consumed from the bottle although this is not meant to be limiting and it may be used for other types of containers and substances.

BACKGROUND ART

When drinking a beverage from a bottle, many consumers prefer to do so when it is cold as this enhances the drinking experience and provides refreshment, particularly in summer months or in warmer climates.

At most points of sale, the bottle containing the beverage is stored in a refrigerator prior to purchase. However, once the bottle is removed from the refrigerator it soon reverts to ambient temperature along with any unconsumed contents. This can detract from the drinking experience, particularly when in a warm climate.

To prolong the cool temperature of the beverage, it may be frozen prior to consumption. This does have drawbacks, including the length of time that must elapse for a sufficient quantity of beverage to be defrosted for consumption. There is also the unpleasant sensation that can arise as large portions of the frozen beverage move about within the bottle while fluid contents are consumed.

The applicants have attempted to solve this problem by providing a bottle with upper and lower compartments, as described in PCT Publication No. WO2014/062071. Prior to consumption of the beverage contained therein, the lower compartment is frozen by being placed on a specifically configured freezing shelf. The contents of the upper compartment remain substantially in a liquid form.

Key to this is the constriction of a passage between the two compartments. This helps minimise the risk of the contents of the upper compartment being frozen.

However, due to the configuration of the bottle there may still be the possibility of potential contact between the contents of the two compartments at the constricted passage. Depending on the temperature of the refrigerator in which the bottle is being cooled, this could mean that crystallization could occur in the upper of the two compartments, leading to undesirable ice formation.

Also, it is the water portion of the content that tends to freeze first. For beverages containing sugars, this is problematic for it means that there can be migration of sugar molecules within the bottle. Unfrozen content may become significantly sweeter due to an increased concentration of sugars. Depending on the beverage, there may also be a colour change.

Another issue that arises is the contents of the upper compartment, while not necessarily being frozen, is still too cold for comfortable consumption. It may be necessary to let the bottle stand for a time for it to reach a temperature that is still cool enough to be refreshing but more comfortable for consumption.

Furthermore, some frozen beverage in the form of chunks of ice may be present as the lower compartment defrosts. Despite the presence of the passage which limits the size of the chunks of ice passing into the upper compartment, some ice may still enter the upper compartment and come into contact with the consumer's mouth. This may present a choking risk or possibly damage teeth.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Further aspects and advantages of the present invention will become apparent from the ensuing description which is given by way of example only.

DISCLOSURE OF THE INVENTION

According to one aspect of the present invention, there is provided a bottle, wherein the bottle includes:

an upper compartment;

a lower compartment including a base, wherein the base includes a raised punt; and a waist portion defining a passage between the upper and lower compartments;

characterised in that the waist portion and/or lower compartment is configured to be temporarily deformed to bring the raised punt into contact with the waist portion thereby constricting the passage between the upper and lower compartment.

According to another aspect of the present invention, there is provided a method of using a bottle, wherein the bottle includes an upper compartment; a lower compartment, wherein the lower compartment includes a base, wherein the base includes a raised punt; and a waist portion defining a passage between the upper and lower compartments; and wherein the lower compartment and/or waist portion is configured to be temporarily deformed to bring the raised punt into contact with the waist portion thereby constricting the passage between the upper and lower compartment, the method including the steps of:

a) deforming the lower compartment to bring the raised punt into contact with the waist portion; and b) placing the bottle in a chiller, wherein the chiller includes a freezing shelf with a surface at least partially complementary to a surface of the bottle.

According to another aspect of the present invention, there is provided a method of using a bottle, wherein the bottle includes an upper compartment; a lower compartment, wherein the lower compartment includes a base, wherein the base includes a raised punt; and a waist portion defining a passage between the upper and lower compartments; and wherein the lower compartment and/or waist portion is configured to be temporarily deformed to bring the raised punt into contact with the waist portion thereby constricting the passage between the upper and lower compartment, the method including the steps of:

a) placing the bottle in a chiller, wherein the chiller includes a freezing shelf with a surface at least partially complementary to a surface of the lower compartment of the bottle; and b) deforming the lower compartment to bring the raised punt into contact with the waist portion.

The invention is a bottle or container for a beverage, which is configured with an upper and lower compartment connected by a waist portion that defines a passage therebetween. Through the use of an appropriately configured freezing shelf, the beverage held in the lower compartment can be frozen at point of sale. The bottle is specifically configured to, upon activation, create a pinch point between the waist portion of the bottle and the punt of the lower compartment. This effectively seals the lower compartment, and its contents, from the upper compartment, or at the very least significantly restricts the passage between the two compartments. The pinch point is achieved through controlled deformation of part of the lower compartment and/or waist portion of the bottle. This is advantageous for it prevents or at least significantly hinders convection circulation between the upper and lower compartments. This significantly reduces the risk of the beverage in the upper compartment of the bottle being frozen. The isolation of the lower compartment from the upper compartment leads to quicker crystallization and ice formation. It also means that the beverage contained in the upper compartment can be held at a higher temperature and thus is easier to consume at the time of purchase and allowing some time for the beverage in the lower compartment to melt and in due course become consumable.

The beverage should be understood to be a liquid that is to be consumed directly from the bottle. For example, and without limitation, this includes carbonated drinks, juices, and even water, flavoured or otherwise. In some embodiments, the bottle may be deliberately underfilled with beverage and thus a portion of the volume of the bottle may be taken up with air after sealing.

Although reference is made throughout the present specification to the invention being a bottle for a beverage, this is not meant to be limiting. The principles of the invention may be applied to bottles or containers that may be used for other substances. For example, the invention may be used for containers containing sauces or other liquid foods.

In exemplary embodiments, the bottle is constructed from plastics material. For example, the bottle may be moulded, extruded, or otherwise formed from polyethylene terephthalate (PET), a plastics material commonly used for manufacturing drink bottles. PET is relatively easily worked using conventional moulding techniques and has resilient properties; this should be understood to mean that subject to thickness, a part or all of a bottle manufactured in PET is capable of returning to its original shape after some deformation.

However, this is not meant to be limiting and other plastics material may be used for construction of the bottle so long as it has the appropriate resiliency properties to perform the invention.

In some embodiments, the bottle is constructed from aluminium, as is commonly used in the beverage industry. Aluminium, subject to thickness and range of deformation, is able to return to its original shape after some degree of deformation. This may be either upon removal of the deforming force or through application of an opposing force. In these embodiments, the bottle is extruded, stamped and otherwise machined using conventional metal working techniques. Typically, this involves forming the base portion of the bottle and then rolling the walls and neck. There may be additional crimping and profiling to shape specific parts of the bottle and to create controlled lines of weakness and/or folds that serve as hinges.

In exemplary embodiments of the invention, the bottle is blow moulded using conventional plastic blow moulding techniques. The blow moulding should result in the bottle having a wall thickness of at least 0.5 mm across the majority of its surface.

However, this is not meant to be limiting and persons skilled in the art will appreciate that strict compliance with the aforementioned wall thickness is not required. For example, the wall thickness across the majority of the bottle surface may be from 0.25 mm to 1 mm. Factors to be considered as part of arriving at a given wall thickness for the bottle will be the desired amount of force required to achieve the controlled deformation described herein.

The bottle should be understood to have an upper compartment and a lower compartment. In use, it is always the lower compartment that is intended to have its contents frozen while the upper compartment is associated with the mouth of the bottle, as discussed later in this specification, and is intended to contain beverage in a liquid state, ready for consumption.

It will be understood that any reference to the bottle having upper and lower compartments is not meant to be limiting. It is possible that when stored in a chiller at point of sale, the bottle may be inverted or in a horizontal orientation due to the particular configuration of the chiller in which it is stored. In this orientation, this means that it may be the lower compartment that is uppermost.

The bottle should be understood to be particularly suitable for use in chillers with specially configured freezing shelves designed to mimic the approximate shape of at least part of the walls and/or base of the bottle. When these freezing shelves contact the walls and/or base of the bottle, they rapidly cool and then, time and temperature permitting, freezes the bottle's contents.

The remainder of the chiller, in which the upper compartment of the bottle is exposed is at a warmer temperature, for example 5° C. This may be through the use of a separate cooling means or alternatively, the presence of the freezer shelf within the chiller itself provides sufficient cooling effect.

The upper compartment should be understood to include a mouth by which the beverage is introduced into the bottle. The consumer will also drink or pour the beverage from the mouth of the bottle.

After introduction of the beverage during the filling of the bottle, the mouth may be closed off with a suitably configured closure such as a conventionally threaded screw cap. In some embodiments, the mouth may also include an additional inner seal applied using conventional induction sealing techniques.

In alternative embodiments, particularly those constructed from aluminium, the bottle could be configured with a lift- or pull-tab type closure, similar to that found on beverage cans.

In exemplary embodiments of the invention, the upper compartment may be configured with a progressive inward taper towards the mouth of the bottle. This inward taper may be considered to be the neck of the bottle.

In exemplary embodiments, the bottle includes at least one displacement panel. As will be appreciated from discussion later in the present specification, there may be a partial displacement or transfer of the contents of the bottle as the lower and/or upper compartment becomes restricted in volume. As the bottle is sealed, the presence of at least one displacement panel helps accommodate this displacement of the beverage and any air that may be present. When activated, the displacement panel also acts to transmit or exert a force or pressure downwards (or upwards, depending on the placement of the panel) through the walls of the bottle to the waist portion and/or lower compartment. However, some embodiments may be configured without a displacement panel and increase in volume, particularly if relatively minimal, may be dealt through other means, such as flexing of the walls or the bottle or its closure arrangement.

The displacement panel should be understood to be an area of the bottle that is configured such that it can move from a flat or inverse/concave structure, i.e. intruding into the volume of the bottle, to a convex structure that extends outwards of the bottle. The displacement may assume a substantially square or rectangular shape but could also be formed as recessed or depressed circles or ovals that assume a dome-like shape when activated.

In exemplary embodiments, the displacement panel is positioned in an area about the circumference of the bottle, i.e. the walls of the bottle. The perimeter of the displacement panel is formed by detail lines moulded into the bottle which define lines of weakness about which the panel may be urged outwards when the bottle is "activated". These lines of weakness are deliberately controlled to provide weaker areas of the bottle that serve as a hinge and so are likely to deform first when a force or pressure is applied to the bottle. This provides greater strength to the structure of the bottle.

In other embodiments, the displacement panel may be placed about the shoulder of the bottle, which allows the upper compartment to be more streamlined. This can also mean that any applied labels are not affected by the movement of the displacement panels.

In some embodiments that include a displacement panel, particularly those in which the bottle is made of aluminium, the displacement panel runs entirely around the circumference of the bottle. In these embodiments, the panel is formed by two profiled lines circumscribing the bottle, preferably at its midportion but above the waist of the bottle, defining the upper and lower extents of the displacement panel.

In further alternative embodiments, the displacement panel may be integrated into the closure arrangement of the bottle, i.e. the cap or seal, if present. This may be preferred where there is relatively little displacement of the contents of the bottle when it is "activated". Thus, the change in volume of the upper compartment relative to the lower compartment may such that it is easily compensated for through an appropriately dimensioned dome or similar structure formed into the cap or seal.

In exemplary embodiments of the invention, once "activated", the detail lines that define the perimeter of the displacement panels mean that the bottle cannot be returned to an "as moulded" state unless an appropriate amount of force is applied to the displacement panels by the user. It will be understood that this means that no further load or force is required to keep the bottle in an "activated" state. The tension applied by the "activated" displacement panels through the walls of the bottle is sufficient for this.

In exemplary embodiments of the invention, it is the upper compartment of the bottle that includes the at least one displacement panel. More preferably, a plurality of displacement panels is provided about the circumference of the upper compartment. In some embodiments, the displacement panels may be located on or proximate the shoulder of the bottle and/or may partially undercut the neck of the bottle.

In exemplary embodiments of the invention, the upper compartment includes at least two or more displacement panels spaced equidistance about the circumference of the bottle. Having a plurality of displacement panels spaced equidistance about the circumference of the bottle also ensures that the tension applied by the displacement panels in an activated state is evenly distributed across the sides of the bottle.

Persons skilled in the art will appreciate that the more displacement panels are present, the greater the volume of the bottle's contents that may be able to be displaced from other parts of the bottle.

Although reference is made throughout the remainder of the present specification to the displacement panels, if present in the embodiment described, being located or otherwise associated with the upper compartment, this is not meant to be limiting. In some embodiments, the displacement panels may be provided to the lower compartment or even about the surface of the punt.

In some embodiments, the bottle may include additional detail moulding, referred to in this specification as pressure points, to assist in the movement or articulation of the displacement panel from its initial concave form into a convex form (or vice versa). In these embodiments, the pressure points are one or more dome-like structures that intersect with a portion of the displacement panel. To articulate the displacement panel, the user squeezes the pressure points which helps urge the displacement panel outwards.

In some embodiments of the invention, particularly those formed from aluminium and requiring relatively minimal displacement of the contained beverage, there may be no need for specifically configured displacement panels. Instead, any change in volume, which may be as little 5 to 10 millilitres, between the upper and lower compartments as the bottle transitions from as "as moulded" state to an "activated" state is accommodated simply through slight flexing of the walls of the bottle. The same may apply to bottles made of plastics material where the wall thickness is relatively high or dense. Alternatively, the bottle may be provided with a closure arrangement as described above that includes a means of accommodating any displacement of the beverage.

In exemplary embodiments, where the bottle includes a distinct waist portion, the upper compartment may include a progressive inward taper towards the lower compartment. This helps to define the waist portion of the bottle.

The waist portion should be understood to be a passage between the upper and lower compartments.

In exemplary embodiments, at least part of the waist portion has a diameter that is reduced relative to the diameters of the upper and lower compartments when the bottle is in an "as moulded" state.

In exemplary embodiments, the diameter of the passage is such that it hinders the flow of large chunks of any frozen beverage from the lower compartment to the upper compartment as the liquid content of the bottle is consumed.

However, in some embodiments, the waist portion will be configured such that its diameter may only become reduced when the bottle is in an "activated" state. In such embodiments, the diameters of the upper compartment, the waist portion, and the lower compartment of the bottle may be substantially constant when in an "as moulded" state. When in this "as moulded" state, the lower compartment may be thought of as the lower portion of the bottle while the upper compartment is the upper portion of the bottle.

The lower compartment should be understood to include a base. In use, the bottle is able to stand upright on the base. It should be appreciated that in some embodiments, at point of sale, the bottle may be orientated in the chiller in a horizontal or inverted state rather than being stood upright on its base. However, once purchased by the consumer, they are likely to want to be able to stand the bottle on its base while not holding it.

In exemplary embodiments, where the bottle includes a distinct waist portion, the lower compartment may include a portion that progressively tapers outwards at least partially towards the base. This helps to define the waist portion of the lower compartment.

The raised punt should be understood to arise from the base of the lower compartment, protruding into the lower compartment. The punt has a lower circumference, where it meets the base of the lower compartment, and an upper circumference, circumscribing a top surface. Walls link the lower circumference to the upper circumference.

In exemplary embodiments of the invention, the punt is a truncated cone arising from the base. However, this is not meant to be limiting, and the punt could be formed as, for example, a cuboid or hexagonal structure although this may complicate the manufacturing process of the bottle and/or its ability to move from its "as moulded" state to an "activated" state.

In a particularly preferred embodiment of the invention, the punt has a top surface which is substantially flat and has a diameter approximating the width of the waist portion of the bottle at its narrowest point. If for example, the diameter or width of the passage is 34 millimetres (mm), then the diameter of the top surface of the punt is at least 34 mm.

In some embodiments, the punt may include elongate recesses running vertically up a portion of the wall of the punt and opening onto the top surface. This may be useful in channeling flow of beverage contained within the lower compartment as the bottle transitions from an "as moulded" state to an "activated" state, particularly as the space between the punt and waist portion becomes restricted.

In some embodiments, the interior of the waist portion of the bottle may be configured with a rib or the like which engages with a channel provided about the circumference of the top surface of the punt (this configuration may also be reversed). This helps ensure a positive fit or lock between the punt and waist portion. Alternatively, the engagement may take place about the walls of the punt. Configurations for allowing the punt to interlock with the waist portion to improve the engagement between these respective components will be readily envisaged by persons skilled in the art.

In exemplary embodiments, the waist portion is configured to temporarily deform to bring a portion of the walls and/or the top surface of the punt, arising from the base of the lower compartment, into contact with the waist portion of the bottle. This forms a pinch point, thereby sealing or at least substantially constricting the passage between the lower and upper compartments.

In an alternative embodiment, the lower compartment is configured to temporarily deform to bring a portion of the walls and/or the top surface of the punt into contact with the waist portion of the bottle. This forms a pinch point, thereby sealing or at least constricting the passage between the lower and upper compartment.

In a further exemplary embodiment, it is the deformation of both the lower compartment and the waist portion together that acts to form the pinch point to seal or constrict the passage between the lower and upper compartments.

If the elongate recesses discussed above are present on the surfaces of the punt, these may terminate before the pinch point to ensure adequate sealing between the waist portion and the punt.

It should be appreciated that the range of movement involved in the deformation of the bottle as it transitions from an "as moulded" state to an "activated" state and back again will depend on the architecture of the waist, lower compartment and punt, the manufacturing process (since some may allow finer control of tolerances than others) and the type of material used in fabricating the bottle.

For example, in embodiments where the bottle is formed from aluminium, the properties of this material may mean that the range of movement is no more than one or two millimetres. For embodiments made of PET, the range of movement may be greater, five to ten millimetres or more. If formed from aluminium, some embodiments may have a waist with a reduced angle compared to a bottle made of plastics material. This is to assist in the reorientation of applied force to the bottle such that any deformation occurs more on the horizontal surfaces of the bottle rather than the vertical surfaces. This may reduce the risking of undesirable buckling.

The invention should be understood to have an "as moulded" state and an "activated" state.

The "as moulded" state is the configuration of the bottle before the pinch point between the punt and the waist portion is created. The bottle will be moulded (or otherwise formed) and bottled in this configuration.

The "activated" state is the configuration of the bottle when the pinch point between the punt and the waist portion has been created. The passage between the upper and lower compartments is either sealed or at the very least significantly restricted such that there is limited transfer of liquid contained within either compartment. If present, the displacement panels will have also "popped" out, having moved from the relatively flat or concave configuration of the "as moulded" state to the convex configuration of the "activated" state, thus allowing capacity for the volume of beverage that may be displaced as a result of the bottle transforming from its "as moulded" state to an "activated" state. If desired, the user could articulate the bottle by, for example, squeezing the displacement panels (or pressure points if present) to return the bottle to its "as moulded" state.

In exemplary embodiments of the invention, the bottle is placed into an activated state at point of sale, i.e. when the bottle is being loaded in a chiller. This is relatively easy to achieve during stocking of the chiller. However, in some embodiments of the invention, the activated state may be formed as part of the filling process or when the bottle is capped. However, it should be appreciated that this may require significant modification of the bottling plant.

The configuration of the lower compartment and/or waist portion to allow the formation of a pinch point between the punt and waist portion is advantageous for several reasons.

The pinch point serves as a thermal break, minimising or preventing migration of ice crystals from the lower compartment to the upper compartment. This helps ensure that the contents of the upper compartment do not inadvertently freeze, even when surrounded by other bottles in the chiller.

It permits the freezing or super-cooling of the contents of the lower compartment relatively quickly, since only a part of the bottle is frozen. The pinch point acts to stop convection movement of the beverage between the upper and lower compartments. This assists in the more rapid cooling of the lower compartment. There may be reduced power demand on the chiller itself because of the potential for improved cooling efficiencies.

Furthermore, for beverages containing sugar, the closing off of the lower compartment from the upper compartment prior to the bottle being frozen minimises the migration of sugar molecules upwards within the bottle as the contents of the lower compartment begins to freeze. Persons skilled in the art will appreciate that the water content of the beverage will freeze before the sugar content.

After purchase, the user may open the bottle to consume the beverage within the upper compartment which is at a cool yet comfortable temperature to do so. For embodiments with displacement panels present, if further cooling of the beverage in this compartment is desired, then the user may apply force to the upper compartment by squeezing the displacement panels or pressure points, or alternatively applying a stretching force by gripping the upper and lower compartments and urging them apart. This results in the displacement panel(s) "popping" back into their concave configuration. This also causes the pinch point at the waist portion and punt to break, thus fully or partially returning the bottle to an "as moulded" state. The frozen (or partially frozen) beverage in the lower compartment is then able to come into contact with that of the upper compartment. The user can therefore control, to an extent, the temperature of the non-frozen beverage by moving the bottle to and from the "activated" state.

Alternatively, they may do this simply to consume the contents of the lower compartment once it has largely or completely melted or at least attained a temperature at which it may be comfortably consumed.

In exemplary embodiments, the lower compartment is moulded with detail features, such as grooves or angles, that define lines of weakness at selected positions to allow the bottle to transition between an "as moulded" state to an "activated" state upon an application of force to part of the bottle. These lines of weakness act as a living hinge.

The lines of weakness may act as fold lines about which the bottle may be appropriately deformed to achieve the desired movement to transition between an "as moulded" state to an "activated" state (and back again).

In exemplary embodiments of the invention, the lines of weakness are created by moulding lines or bands at strategic points about the lower compartment to form the living hinge. In some embodiments of the invention, the lines of weakness may be partially integrated with the waist portion of the bottle. This may be of assistance in allowing the right level of deformation required for the bottle to move from an "as moulded" state to an "activated" state.

Alternatively, these lines or bands may be moulded into the bottle to reduce the thickness of the wall at these points of the lower compartment, thus defining an area that functions as the living hinge.

For example, the lines of weakness may be such that at these points, the wall thickness is 0.2 to 0.4 mm for bottles moulded from PET. To provide appropriate resistance and to avoid undesired deformation of other parts of the lower compartment, beneath the lines of weakness, the wall thickness may be significantly increased to, for example, 2 mm. For bottles of aluminium, the wall thickness may be less.

In the recited example of a bottle made of PET, the force to be applied approximates 86 Newtons (N) or about 10 kilograms (kg). When returning the bottle to an "as moulded" state following activation, about 26 N, or about 2 kg may be required.

It should be appreciated that the above stated wall thicknesses are recited as examples only, and persons skilled in the art will appreciate that strict compliance with these is not required. However, it will also be understood that there is a balance to be struck between an appropriate wall thickness and the force required to transition the bottle from an "as moulded" state to an "activated" state, regardless of whether the bottle is formed from plastics material or aluminium. What may also be a factor is the need to allow for the possibility for repeated movement of the lower compartment about the lines of weakness. This may happen if the user refills and reuses the bottle. The wall thickness at the line of weakness thus may need to withstand repeated deformation.

In this embodiment, the force to deform the lower compartment is applied downwards, from the top of the bottle. This means that upwards of the lines of weakness, the wall thickness need not be as high as below the lines of weakness. For example, the wall thickness of the upper compartment may be 0.8 mm to 1.0 mm. Persons skilled in the art will appreciate that the neck and mouth of the bottle may be thicker as it needs to be sufficiently resilient to withstand the force applied when the bottle is capped.

The lines of weakness may be relatively wide, and thus should be considered a band of weakness. In these embodiments, the band of weakness may be moulded with ridges or the like to define specific hinges at which the band may deform. The advantage of this is that it allows progressive movement of the waist portion and/or punt. Thus, the bottle may be able to move from an "as moulded" state to an "in between" state, where the pinch point has yet to be fully formed but the passage is still partially constricted, to the "activated" state. There may be more than one "in between" state, depending on the number of ridges present within the band of weakness.

In another exemplary embodiment, the lines of weakness may be created by moulding detail features such as corrugations or similar structures in the wall of the lower compartment. In this embodiment, the wall thickness is consistent and deformation of the walls occur at where the corrugations intrude into the lower compartment. Preferably, the plastic would simply bend about these detail features. However, persons skilled in the art will appreciate that the bottle may be moulded with a wall thickness that assists in this deformation but without requiring excessive force to achieve it.

The lines or bands of weakness may be located at different points of the lower compartment, depending on the preferences of the manufacturer and available moulding techniques and equipment. The lines of weakness may extend into the waist portion of the bottle.

It will be appreciated that relatively fine control of the moulding process may be required and it is typically easier to achieve the desired tolerances for wall thickness the higher up the bottle these are.

In another exemplary embodiment, the lines of weakness may circumscribe a section of the waist portion and the lower compartment of the bottle. In use, this configuration brings the waist portion downward into contact with the punt to create the pinch point.

In this embodiment, the lines of weakness may be in series and arranged substantially horizontally when the bottle is upright, i.e. perpendicular to the vertical. Having more than one line of weakness allows the deformation of the lower compartment to be progressive.

In some embodiments of the present invention, one or more lines of weakness may be arranged such that collectively these act as a spring when compressive force (or even a twisting force) is applied to the appropriate part of the bottle. At least a portion of the lower compartment deforms to bring the waist portion and the punt into contact.

In these embodiments, the bottle may include detail features, such as a moulded or machined groove, rib, or the like, which may be located upwards and downwards of these lines of weakness. These act to limit the area of deformation of the bottle to the area between the detail features. Without them, then there may be unintentional deformation of other areas of the bottle, depending on the extent of the force applied.

For example, one or more lines of weakness may be provided as a continuous spiral or helix, circumscribing the lower compartment of the bottle, and in some embodiments at least part of the waist portion. When force is applied, these lines of weakness act in a manner similar to a spring.

Alternatively, the lines of weakness may be arranged such that they are diagonal or angled from the vertical. In this embodiment, the lines of weakness form a series of diagonal panels spanning at least part of the waist portion and, in some embodiments, at least part of the lower compartment of the bottle. The upper and lower ends of the panels may be defined by moulded detail lines. These detail lines act to limit the deformation of the bottle to the area defined by the diagonal panels.

In another exemplary embodiment of the invention, the lines or bands of weakness circumscribe the lower compartment beneath the waist portion. In use, this configuration brings the waist portion downward into contact with the punt to create the pinch point. In this embodiment, there is no deformation of the bottle at the waist portion so the wall thickness at this point may be increased relative to the portion of the lower compartment with the lines of weakness.

The lines of weakness may be in series and arranged substantially horizontally when the bottle is upright, i.e. perpendicular to the vertical.

In some embodiments of the present invention, one line of weakness may be provided as a spiral or helix, similar to a spring. This spiral may circumscribe part or all of one or both of the waist portion and lower compartment.

In these embodiments, when force is applied to the bottle, either from above or below, it can compress about the line or lines of weakness to bring the punt into contact with the waist portion and seal off the lower compartment. One useful advantage of these embodiments is that by virtue of being able to be partially compressed, the bottle may take up less space in landfill.

In another exemplary embodiment, the punt includes at least one line of weakness around its lower circumference that links it to the base of the lower compartment. In use, this configuration brings the punt upwards into contact with the waist portion to create the pinch point. It will be appreciated that this embodiment may require force to be applied to the punt portion of the lower compartment in order to move the bottle from its "as moulded" state to an "activated" state.

In another exemplary embodiment, the punt includes at least one line of weakness partway up around its wall. In use, this configuration brings the portion of the punt above the line of weakness into contact with the waist portion to create the pinch point. As with the previous embodiment, this embodiment may require force to be applied to the punt portion of the lower compartment.

In this embodiment, the lines of weakness may be in series and arranged substantially horizontally when the bottle is upright, i.e. perpendicular to the vertical. In some embodiments of the present invention, one line of weakness may be provided as a spiral or helix, similar to a spring.

The present invention has a number of advantages, including:

- provides the retailer with a bottle specifically configured with a compartment containing a beverage that can be frozen relatively quickly and efficiently; or
- avoids sugar concentrating in upper parts of the bottle when being frozen; or
- provides the user of the bottle with a beverage that has a portion that is ready for consumption after purchase while the remainder is frozen; or
- providing the user of the bottle to control, to a certain extent, the rate of cooling of the beverage within the bottle; or
- helps to control the movement of ice within the bottle; or
- provides a retailer with a point of difference to conventional beverages; or
- readily used with existing bottling plants with minimal or no modifications to the plant required; or
- for some embodiments, may reduce volume in landfill.

At the very least, the present invention offers the public a useful choice.

BRIEF DESCRIPTION OF FIGURES

Further aspects of the present invention will become apparent from the following description which is given by way of example only and with reference to the accompanying drawings in which.

DETAILED DESCRIPTION OF THE FIGURES

Figure 1:
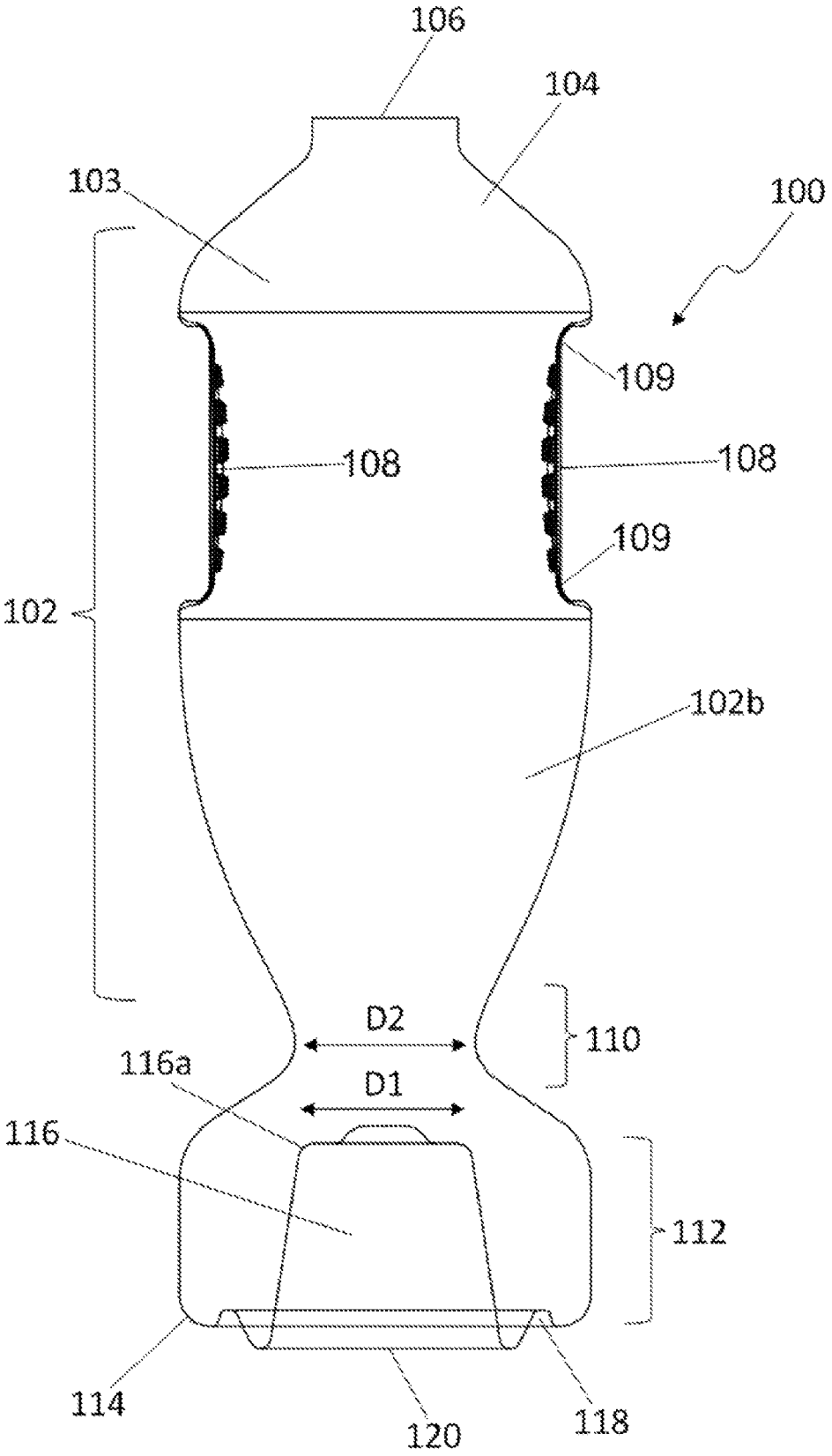
FIG. 1 is a side view of a first embodiment of the present invention.

In FIG. 1, the anatomy of an exemplary embodiment (100) of the present invention can be considered.

As can be seen, the invention is a bottle (100) and it is specially designed such that at least a portion of the beverage (not shown) contained within can be frozen upon placement in an appropriately configured freezing shelf in a chiller or the like (not shown).

The bottle (100) includes an upper compartment (102), which at its upper most end (102*a*) is defined by a neck (104) that leads to the mouth (106) of the bottle. Once the bottle is filled with the beverage (not shown) to be contained, the mouth of the bottle is closed with a seal and/or cap (not shown) to preserve its contents.

Below the neck (104) of the bottle (100), the upper compartment (102) tapers outwardly to define the shoulders (103) of the bottle.

About the circumference of the upper compartment (102) are provided at least two displacement panels (108) defined by detail lines (109). These displacement panels are urged outwards upon application of a force to the bottle (100) to accommodate an increase in volume of the upper compartment. It will be appreciated that the surrounding areas are substantially squared off to direct and channel applied forces and to allow the displacement panels to be moveable.

The displacement panels increase the capacity of the upper compartment for the contents of the bottle, which flows upwards as the volume of the lower compartment decreases, as will become apparent from further discussion of the bottle.

Seen here in a relatively concave configuration, when sufficient force has been applied, the displacement panels (108) will "pop" outwards into a convex configuration. The detail lines are appropriately moulded such that once "popped", the displacement panels cannot freely return to an "as moulded" state unless an appropriate force is applied to the bottle. This is useful, for it ensures that the bottle (100) remains in an "activated" state.

It will be appreciated that the movement of the displacement panels (108) occurs primarily around the detail lines (109), which serve as a living hinge. This leaves the main portion of the displacement panels substantially flat and thus an ideal surface for applying any labelling that may be desired.

Figure 2A:
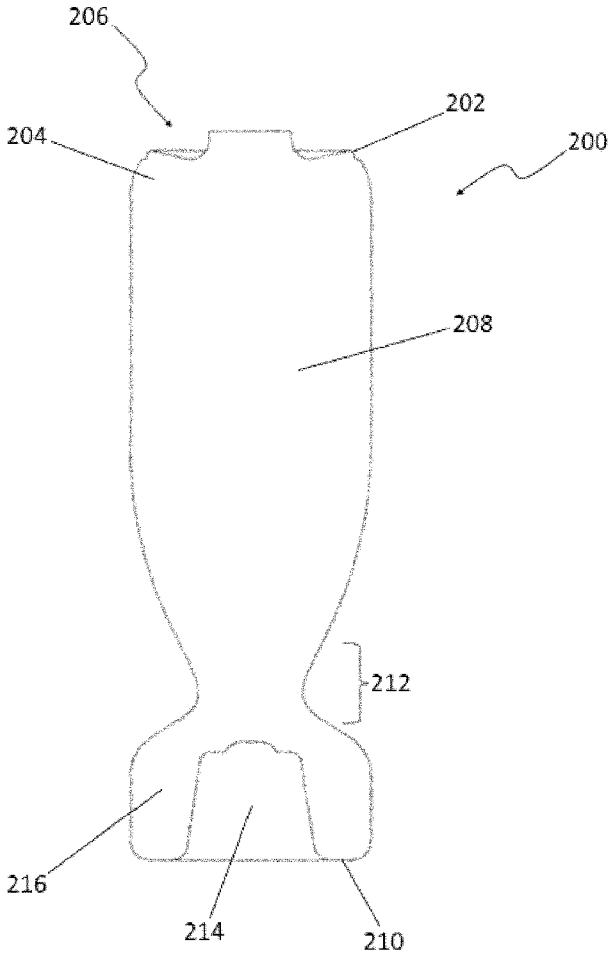
FIG. 2A is a side view of an alternative embodiment of the present invention.
Figure 2B:
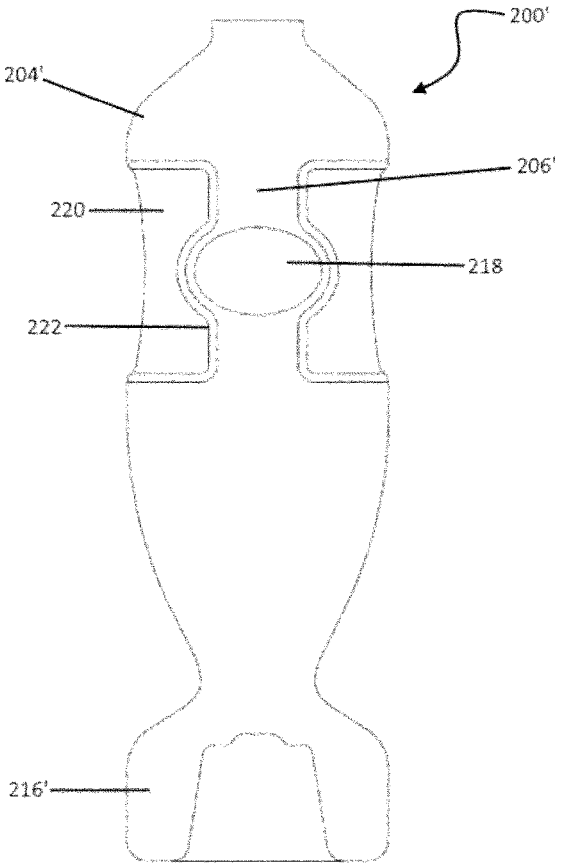
FIG. 2B is a side view of a further alternative embodiment of the present invention.

Alternative configurations for the displacement panels are shown in FIGS. 2A and 2B. In FIG. 2A, the bottle (200) is configured with a detail line (202) circumscribing the shoulder (204) of the bottle. With the bottle shown in an "as moulded" state, the detail line serves as a hinge for the neck and mouth portion (206) of the bottle, which assumes an inverted configuration. When the bottle is "activated", for example by the consumer gripping the sides of the upper compartment of the bottle and applying a pushing force towards the base (210), this causes deformation about the waist (212) such that it seals against the punt (214).

In response to the partial displacement of the contents of the lower compartment (216), the hinge (202) pivots to allow the neck and mouth portion (206) to move upwards and assume a more conventional configuration, where the neck tapers outwardly to the shoulder of the bottle. Although not shown here, the neck may include additional detail lines to assist in the movement of this area of the bottle from its inverted state into the conventional configuration.

The advantage of this arrangement is that it allows the upper compartment (208) to assume a more contoured form without the hinderance of displacement panels. This may be preferred for aesthetic or production reasons. For example, the manufacturer may prefer to have a label applied to the entire circumference of the upper compartment without the constraints of having a label only applied to a flat portion of the displacement panel, as is the case with the embodiment of FIG. 1, or having displacement panels arising from the sides of the bottle affecting its appearance when activated.

In FIG. 2B, the bottle (200') includes activation pressure points (218) that interact with the displacement panels (220). This activation pressure point is in the form of a raised dome-like structure that intrudes into the detail lines (222) that define part of the displacement panels. The user can apply force to the activation pressure point which helps urge the displacement panel from its initial concave form into a convex configuration to assist in the increase in volume of the upper compartment (208') to accommodate displacement of the bottle's contents as the lower compartment (216') is reduced in volume.

The displacement panels (220) of the bottle (200') are shown as with substantially straight edges, aside from the portion into which the activation pressure points intrudes, such that when viewed from the front they assume a square or rectangular shape. It should be appreciated that it is possible that these panels could be formed as substantially oval or circular structures instead, although the surrounding area, for example the shoulder (204'), may still need to squared off to assist in channeling applied forces towards the panels.

Returning now to FIG. 1, at its lower end (102*b*), the upper compartment (102) progressively tapers inwardly to a waist portion (110). This waist portion serves as a passage between the upper compartment and a lower compartment (112). Although in the illustrated embodiment the waist is clearly defined and has a reduced diameter relative to the upper and lower compartments, in other embodiments (not shown), the waist portion may have a diameter that is substantially similar to that of the upper and lower compartments when in an "as moulded state". It may only have a reduced diameter when moved to an "activated" state. However, the waist portion will be configured to achieve this as will become apparent later in this specification.

It is the lower compartment (112) that is intended to hold the portion of any beverage to be frozen. It can be seen that the lower compartment is defined by the waist portion (110) and the base (114) of the bottle (100), on which it stands when being stored in a refrigerator (not shown).

Arising from the base (114) and intruding into the lower compartment (112) is a raised punt (116). It will be appreciated in this embodiment, the diameter $D^1$ of the top side (116*a*) of the punt approximates the diameter $D^2$ of the waist portion (110) of the bottle (100) at its narrowest point. As will be seen from the following discussion, the punt is capable of deformation such that the top side of the punt creates a pinch point with the waist portion at its narrowest point. This acts to seal, or at least substantially close, the waist portion to prevent or minimise transfer of any beverage between the upper (102) and lower compartments (112).

The punt (116) is configured as a flat conical structure and its dimensions are such that it takes up a portion of the volume of the lower compartment (102). Being configured in this way, the presence of the punt means that any beverage (not shown) within the bottle (100), when frozen, does so in a ring. Depending on the relative dimensions of the punt, after being removed from the chiller (not shown) from where it was purchased, the consumer may be able to break up any frozen beverage for consumption as required or it may be left to gradually melt.

The punt (116) is configured with a hinge (118) about its bottom circumference, where it joins the base (114) of the bottle (100). This hinge, where the thickness of the plastic is reduced relative to the rest of the base of the bottle, defines a line of weakness.

It will be seen that the bottom (120) of the punt (116) sits proud of the base (114) of the bottle. Force needs to be applied to this area of the bottle in order to advance the punt into the lower compartment (112) such that it engages with the waist portion (110) to activate the pinch point.

Figure 3:
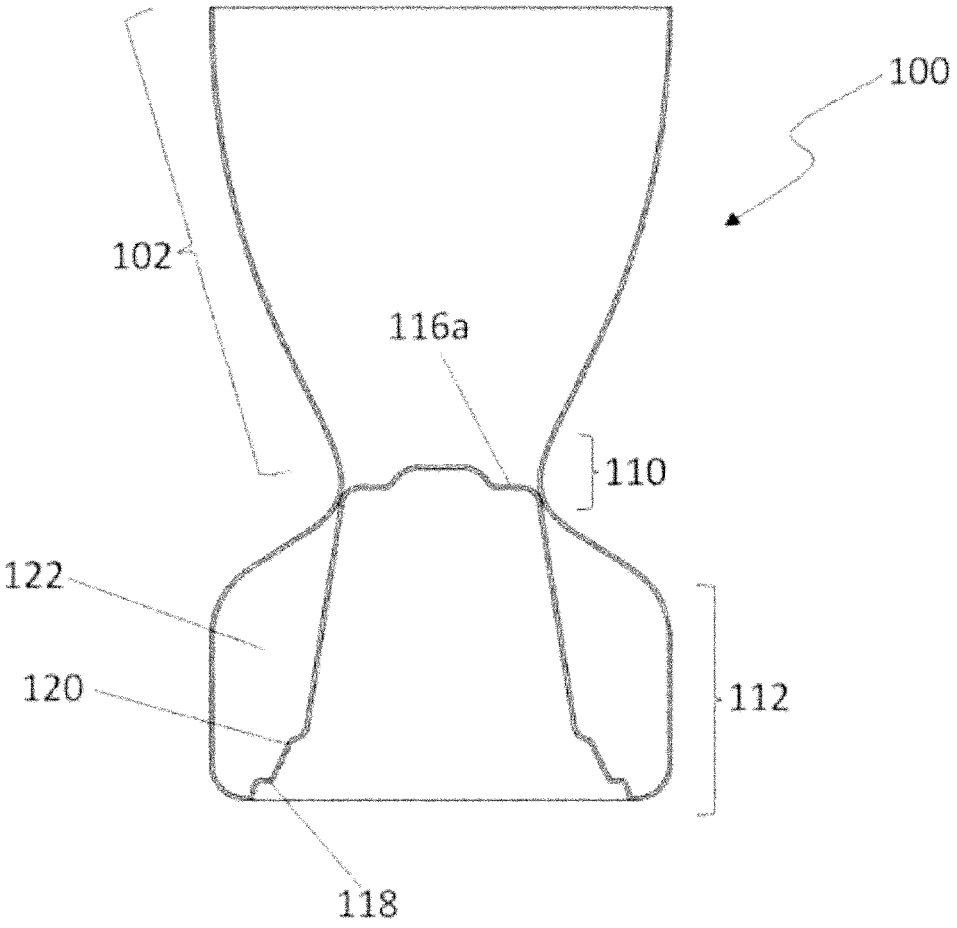
FIG. 3 is a close up side view of a portion of the embodiment of FIG. 1 in an "activated" state.

When force is applied to the bottom of the punt (116), as shown in FIG. 3, the hinge (118) allows the punt to move or otherwise be displaced vertically. This displacement brings the top side (116*a*) of the punt into sealing contact, or near sealing contact, with the waist portion (110) of the body. The bottom (120) of the punt no longer sits proud of the base of the bottle. The bottle is now in an "activated" state.

It will be appreciated that this means that the volume of the lower compartment (112) decreases due to the effective increase in space taken up by the punt (116). A portion of the beverage (not shown) within the lower compartment moves into the upper compartment (102, not shown in its entirety).

As the beverage cannot escape the bottle (100) by virtue of being closed off, to accommodate the extra beverage now present in the upper compartment (102), the displacement panels (108 in FIG. 1) "pop" outwards. This is due to the increase in pressure in the upper compartment resulting of the transfer of some beverage from the lower compartment (112). The displacement panels will now be in a relatively convex configuration as opposed to the relatively concave configuration of FIG. 1. The detail lines (109) ensure that the displacement panels cannot freely return to their "as moulded" state. Instead, they direct force down the walls of the bottle to ensure the contact at the waist portion (110) and top side (116*a*) of the punt (116) is maintained.

In some embodiments, the punt may include features to assist in the movement of the beverage contained within the lower compartment (112) to the upper compartment (102) as the bottle moves from its "as moulded" state to an "activated state".

Figure 4A:
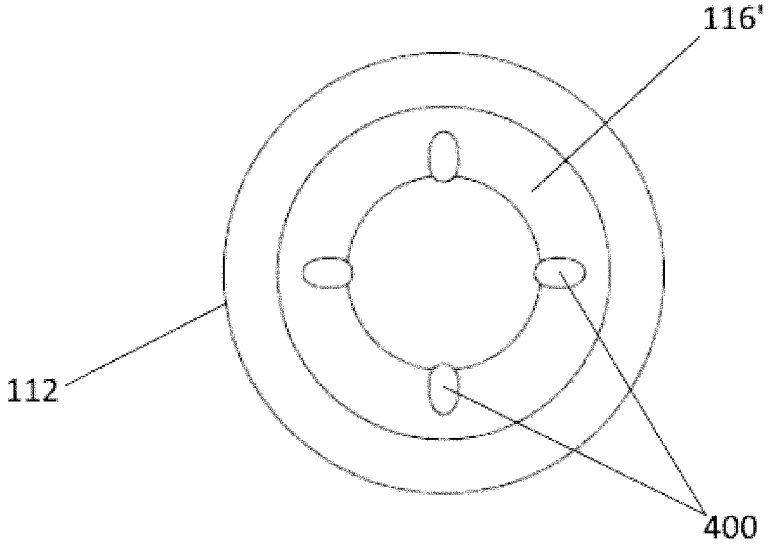
FIG. 4A is a top view of one embodiment of the punt.
Figure 4B:
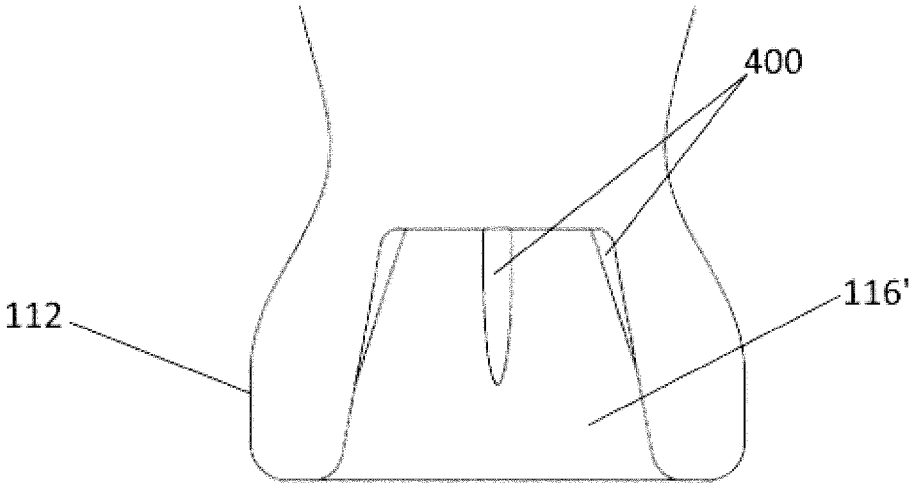
FIG. 4B is a side view of the punt of FIG. 4A.

This is shown in FIGS. 4A and 4B, top and side views respectively, of one embodiment of a punt (116') within the lower compartment (112). It will be seen that small recesses (400) have been moulded equidistance around the surfaces of the punt, defining channels for the beverage to flow along as the space between the side walls/top of the punt become increasingly restricted as it meets the waist portion.

Returning to the embodiment of FIG. 3, it will be appreciated that any beverage (not shown) remaining in the lower compartment (112) is contained within the area (122) and, because of the presence of the punt (116), will freeze as a ring when placed in an appropriately configured freezing shelf (not shown) within a chiller or refrigerator (not shown).

Figure 5:
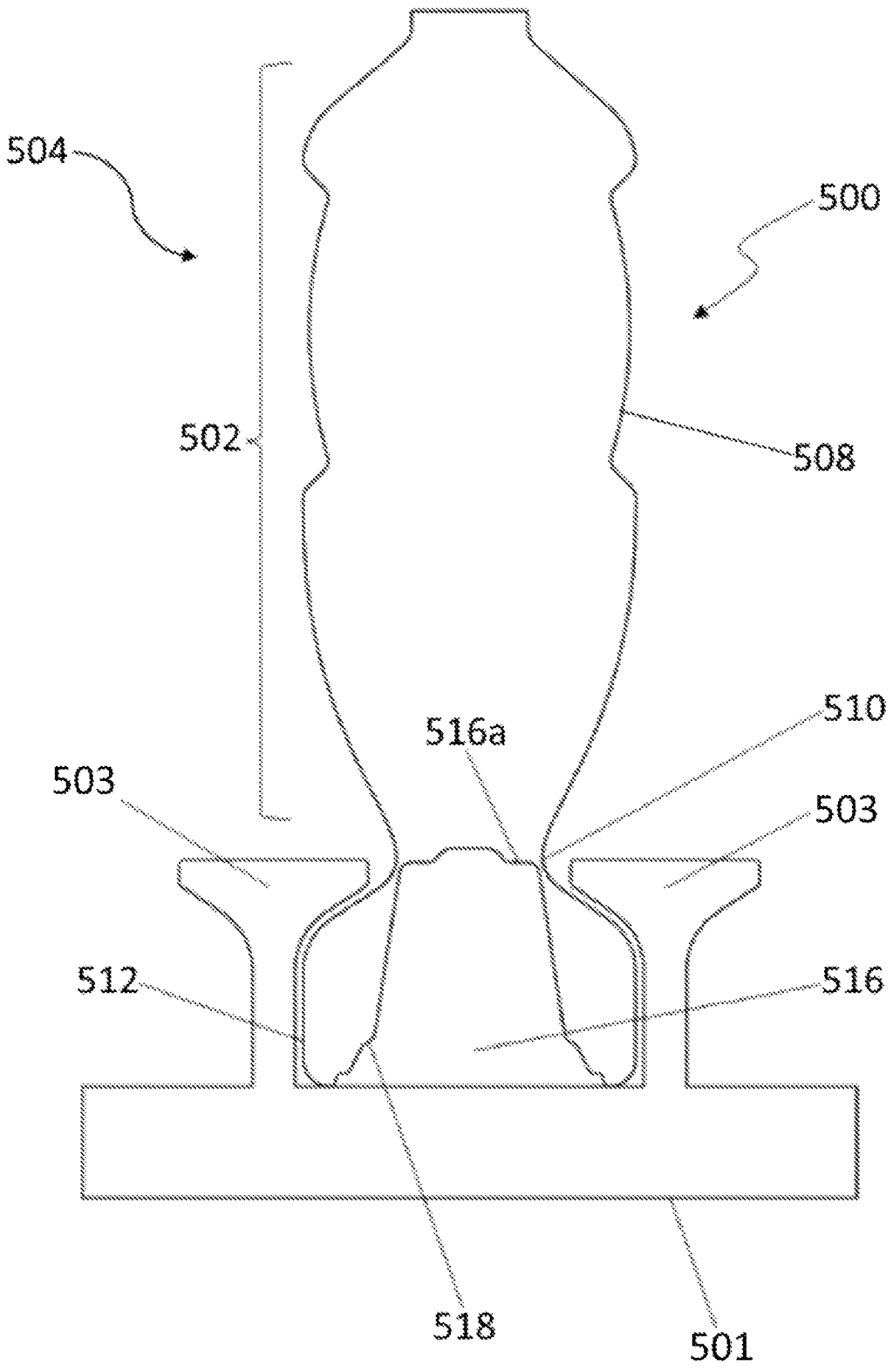
FIG. 5 is a front view of an alternative embodiment of the present invention when in a freezer shelf.

This freezing shelf (501) can be seen in FIG. 5 retaining an embodiment of the bottle (500) in an "activated" state. It will be seen that it includes rails (503) that closely conform to the profile of the lower compartment (512).

The relative height of the rails (503) is a little less than the height of the lower compartment (512) when the bottle is in its "as moulded" state. This means that the lower compartment is squeezed as the bottle is inserted into the channel between the rails. This activates the punt (516), urging it inwards into the lower compartment and thus closing the waist portion (510) and substantially sealing the passage between the lower and the upper (502) compartments.

The rails (503) are cooled to well below freezing and through conduction, will freeze the contents of the lower compartment (512). However, the remaining area of the chiller (generally indicated by arrow 504) with which the freezing shelf (501) is to be used is kept slightly above freezing.

As the lower compartment (512) is sealed from the upper compartment (502) by virtue of the pinch point created by the top side (516*a*) of the punt (516) and the waist portion (510), the beverage within the upper compartment is unlikely to be frozen, but is still chilled, and thus is able to be consumed straight after purchase.

The user may opt to return the bottle (500) to an "as moulded" state which can be achieved simply by pulling on the lower compartment (512) of the bottle. The resulting pressure on the waist portion (510), where it contacts the top side (516*a*) of the punt (516), causes movement of the punt about the hinge (518), away from the waist portion. This allows the contents of the lower compartment to mix with that of the upper compartment (502). If the contents of the lower compartment are still largely frozen, the contact with the beverage of the upper compartment helps chill the latter and/or accelerate defrosting of the former.

Another way of returning the bottle (500) to an "as moulded" state is through the user applying force to the displacement panels (508), by squeezing them together. When sufficient force is achieved, which can be as little as 2 kilograms (kg), the displacement panels "pop" back in. The resulting increase in pressure within the upper compartment (502) urges the waist portion away from the punt (516). Of course, the user may need to replace the closure to achieve this without risking any spillage of the remaining beverage.

It will be appreciated that there may be more than one line of weakness in the lower compartment and these may be in different locations to that shown in FIGS. 1 and 5.

Figure 6A:
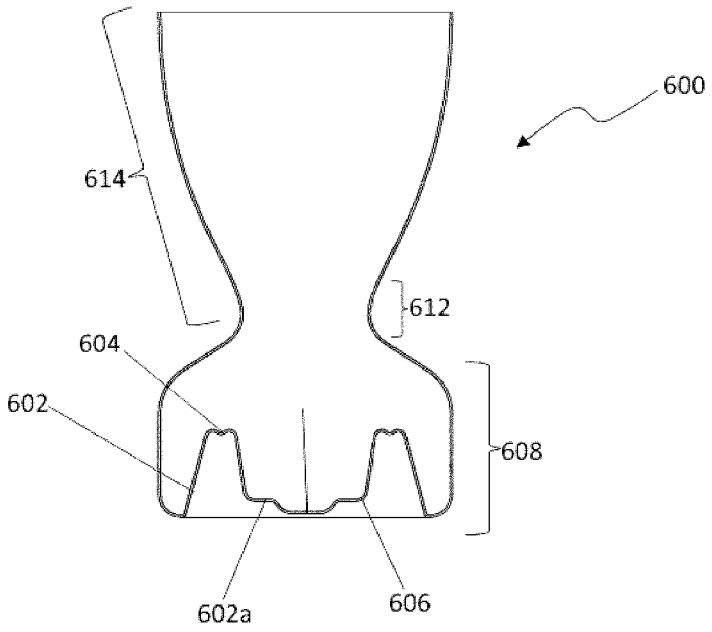
FIG. 6A is a front view of a further alternative embodiment of the present invention in an "as moulded" state.
Figure 6B:
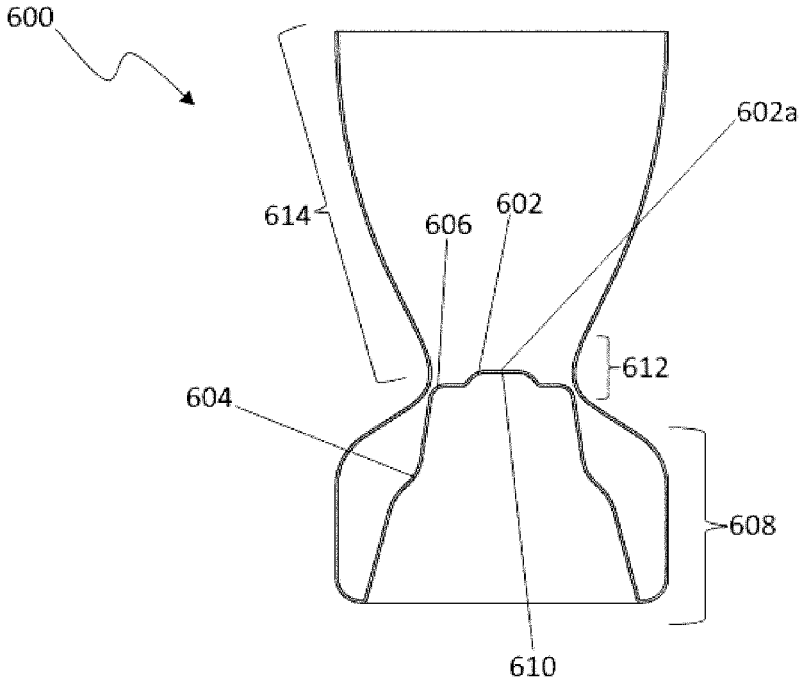
FIG. 6B is a front view of the embodiment of FIG. 6A in an "activated" state.

For example, an alternative bottle embodiment (600) is depicted in FIGS. 6A and 6B. In this embodiment, the raised punt (602) may be configured with two distinct lines of weakness (604, 606). Dealing with FIG. 6A first, this shows the lower compartment (608) in an "as moulded" state. Here, the first line of weakness (604) is part way up the wall of the punt. The second line of weakness (606) is positioned about the circumference of the top side (602*a*) of the punt.

When force is applied to the underside (610) of the punt (602), this causes movement of the punt about the lines of weakness as shown in FIG. 6B. This movement creates the pinch point between the top side (602*a*) of the punt and the waist portion (612) and substantially or fully sealing off the lower compartment (608) from the upper compartment (614). The displacement panels (not shown) also move as described in respect of the previous embodiments.

In the bottle embodiments of FIGS. 1 to 6B, the force is applied to the base of the bottle while its top is restrained in order to transition it from an "as moulded" state to an "activated" state (and back again as required). However, the bottle can be configured with lines of weakness arranged to be responsive to a force applied to the upper compartment while the base is restrained.

Figure 7A:
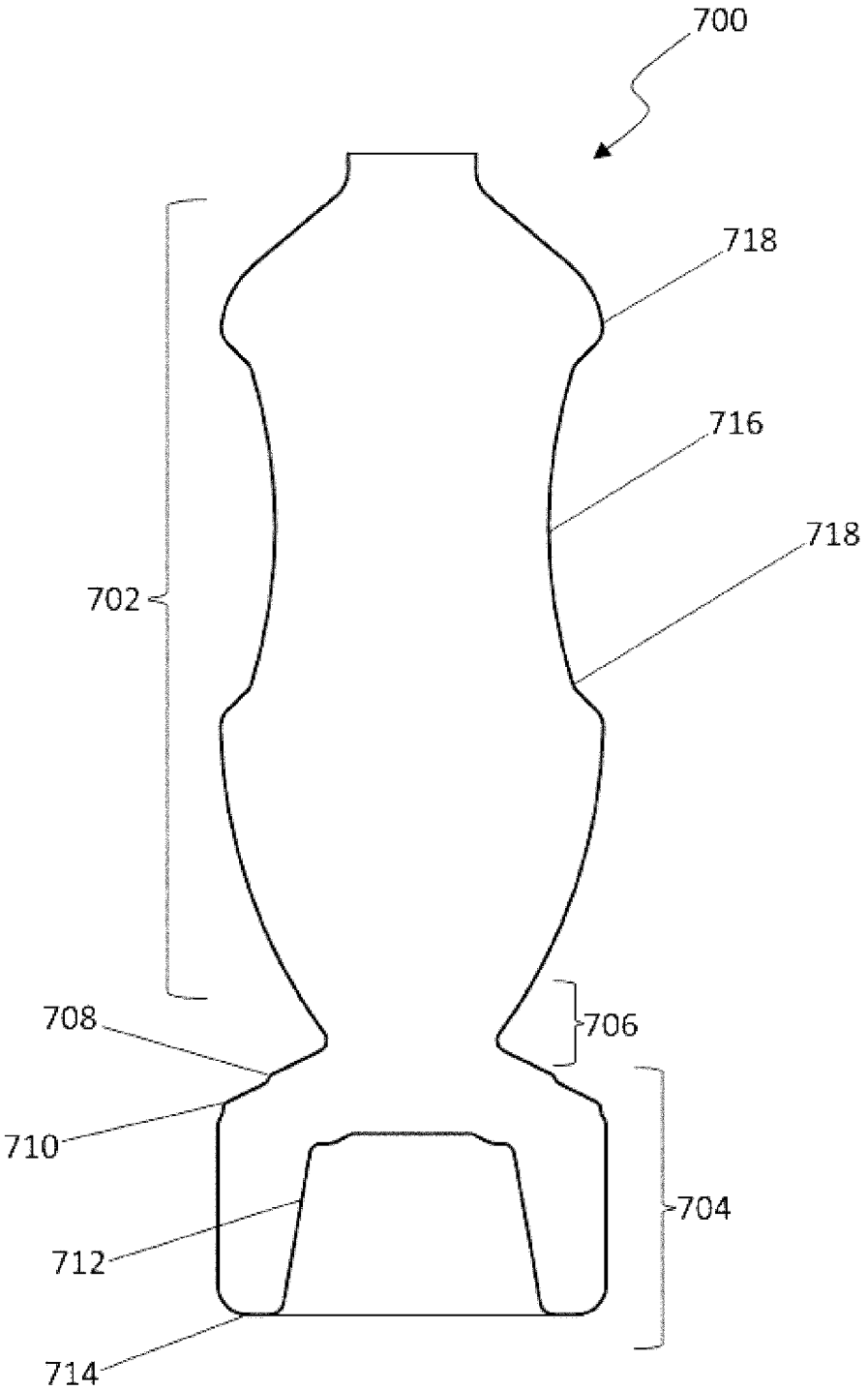
FIG. 7A is a front view of yet another embodiment of the present invention in an "as moulded" state.
Figure 7B:
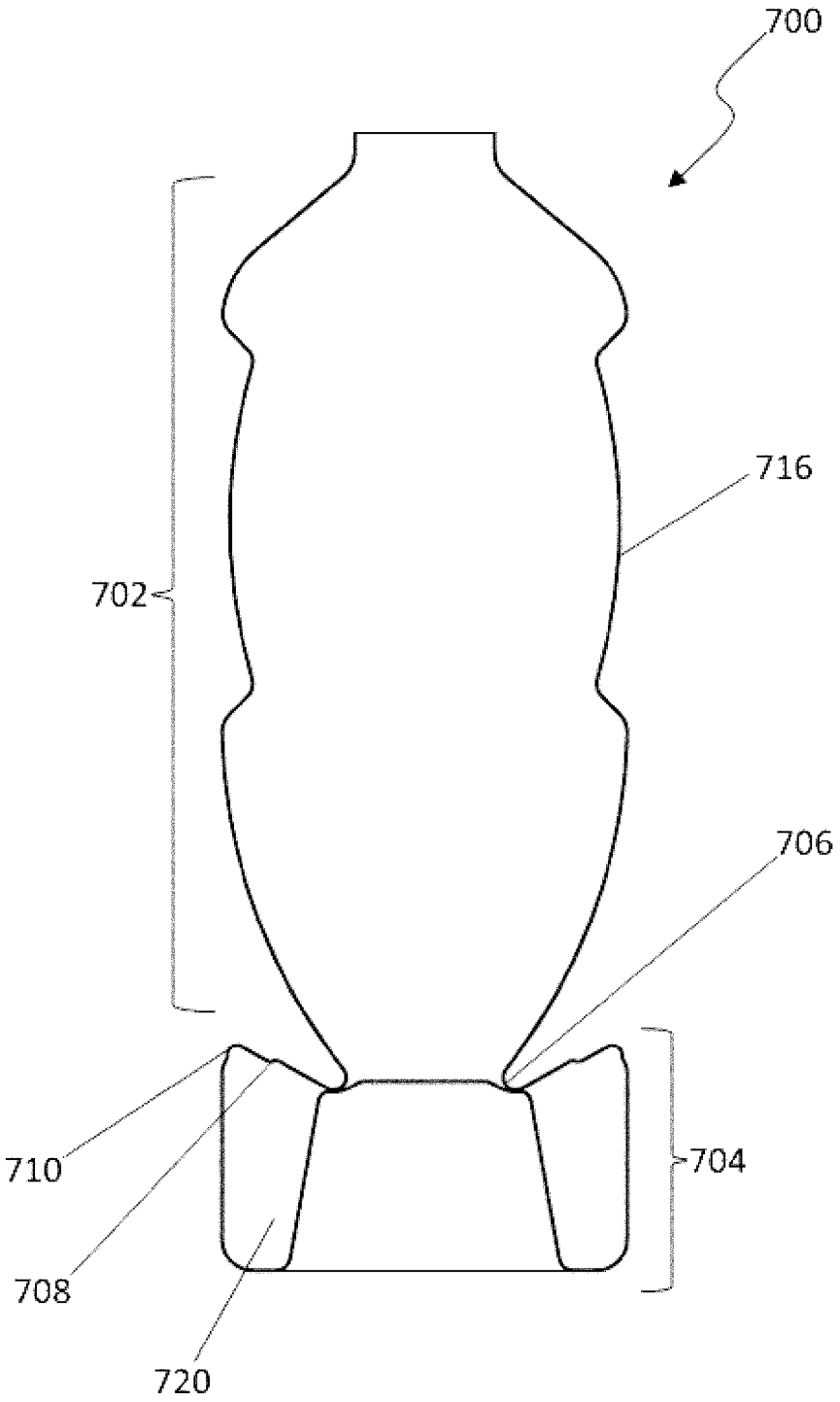
FIG. 7B is a front view of the embodiment of FIG. 7A in an "activated" state.

A bottle embodiment (700) exemplifying this is shown in FIGS. 7A and 7B. As with previous embodiments, the bottle includes upper (702) and lower compartments (704) separated by a waist portion (706) defining a passage between the two compartments.

Here it can be seen that the lower compartment (704), as it tapers outwardly from the narrowest point of the waist portion (706), includes circumscribing lines of weakness (708, 710). As in the previous embodiments, the lower compartment includes a raised punt (712) arising from the base (714) of the bottle (700). However, in contrast to the previous embodiments, the punt lacks any lines of weakness and is thus a relatively rigid and immobile structure. Although the bottle shown is moulded in plastics material, this lower compartment configuration would also be suitable for use with bottles formed from aluminium. However, the architecture of the punt would change to take into account the relatively little range of movement that is allowed with aluminium before it buckles or kinks. This would result in the punt being larger in height such that it reaches sealing contact with the waist portion with minimal movement.

Also visible in FIG. 7A are the displacement panels (716) of the upper compartment (702) of the bottle (700). These are recesses into the walls of the upper compartment. The panels are bounded with lines of weakness (718) to assist in their movement when required. Because the bottle is depicted in this figure in its "as moulded" configuration, the panels are concave.

To substantially seal the upper and lower compartments, a pinch point is formed between the punt (712) and the waist portion (706) when downward pressure is applied to the upper part of the bottle (700), as shown in FIG. 7B. This may be by a person pushing downwards on the cap (not shown) as they are placing the bottle in the chiller (not shown) at point of sale. This may also be achieved by biasing a structure, such as a shelf (not shown), downwards against the cap. If the base is already sitting on the shelf of the chiller, then this would compress the bottle. The lower compartment would then deform about the lines of weakness (708, 710) bringing it into contact with the punt.

As some of the contents (not shown) of the lower compartment (704) is forced into the upper compartment (706), which could be as much as 65 millilitres (mL) for a 750 mL bottle, the latter's volume increases by virtue of the displacement panels (716) popping outward to assume a convex configuration. The lower compartment is now substantially sealed and when chilled to an appropriate temperature, any beverage contained within the sealed portion (720) of the compartment may become frozen.

It should be appreciated that the force or tension exerted through the displacement panels (716) down the walls of the bottle (700) is sufficient to maintain the pinch point between the waist portion (706) and the punt (712). Thus, the bottle will remain in an "activated" state and the original force applied (for example, by the person pushing downwards on the cap) can be removed.

The invention is intended to allow the contents of the lower compartment (704) to be frozen, or at least super-chilled, by an appropriately configured chiller (not shown).

For example, the bottle may be located on a shelf cooled to a temperature less than that of the main refrigerator. The activation of the punt is through the pressure applied to the bottle as it is inserted into the shelf. This will require the use of an appropriately configured shelf.

This could be through the vertical spacing between the adjacent shelves; this could be deliberately arranged to be slightly less than the height of the bottle in its "as moulded" state. When the bottles are loaded into the shelves, it is effectively squeezed between them, thereby activating the punt such that it pops into sealing contact with the waist portion of the bottle. To facilitate ease of loading, the upper shelf may be slightly declined, front to back.

Alternatively, the shelf could be configured with channels profiled with projections that substantially correspond to the waist portion of the bottle (as shown in FIG. 5).

Figure 8A:
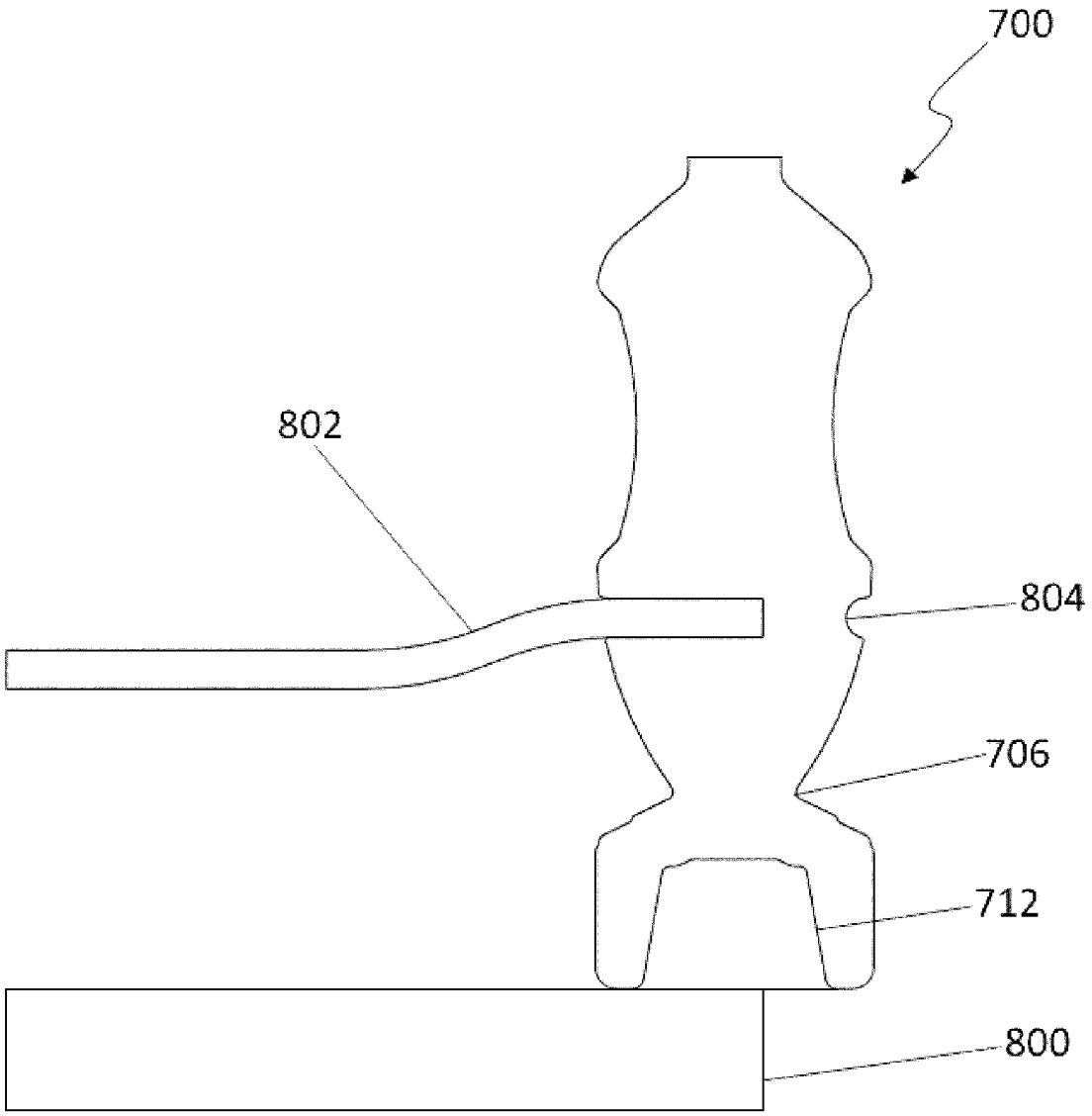
FIG. 8A is a side view of the embodiment of FIG. 7A in a specifically configured shelf at point of sale, prior to being "activated"

An example of an appropriately configured shelf is illustrated in FIG. 8A. This shows a chiller shelf (800) that allows the bottle (700) illustrated in FIGS. 7A and 7B to be "activated" at point of sale.

The shelf (800) is configured with guide rails (802) complementary to recesses or grooves (804) moulded into the sides of the bottle (700). The initial height of the guide rails is substantially the same as the recesses when the bottle is in its "as moulded" state. This is appropriate, for the bottles would be filled with a beverage, sealed with caps, and delivered to the retailer in this configuration. The retailer would then load the bottles into the chiller to refrigerate the bottle for purchase by a consumer.

Figure 8B:
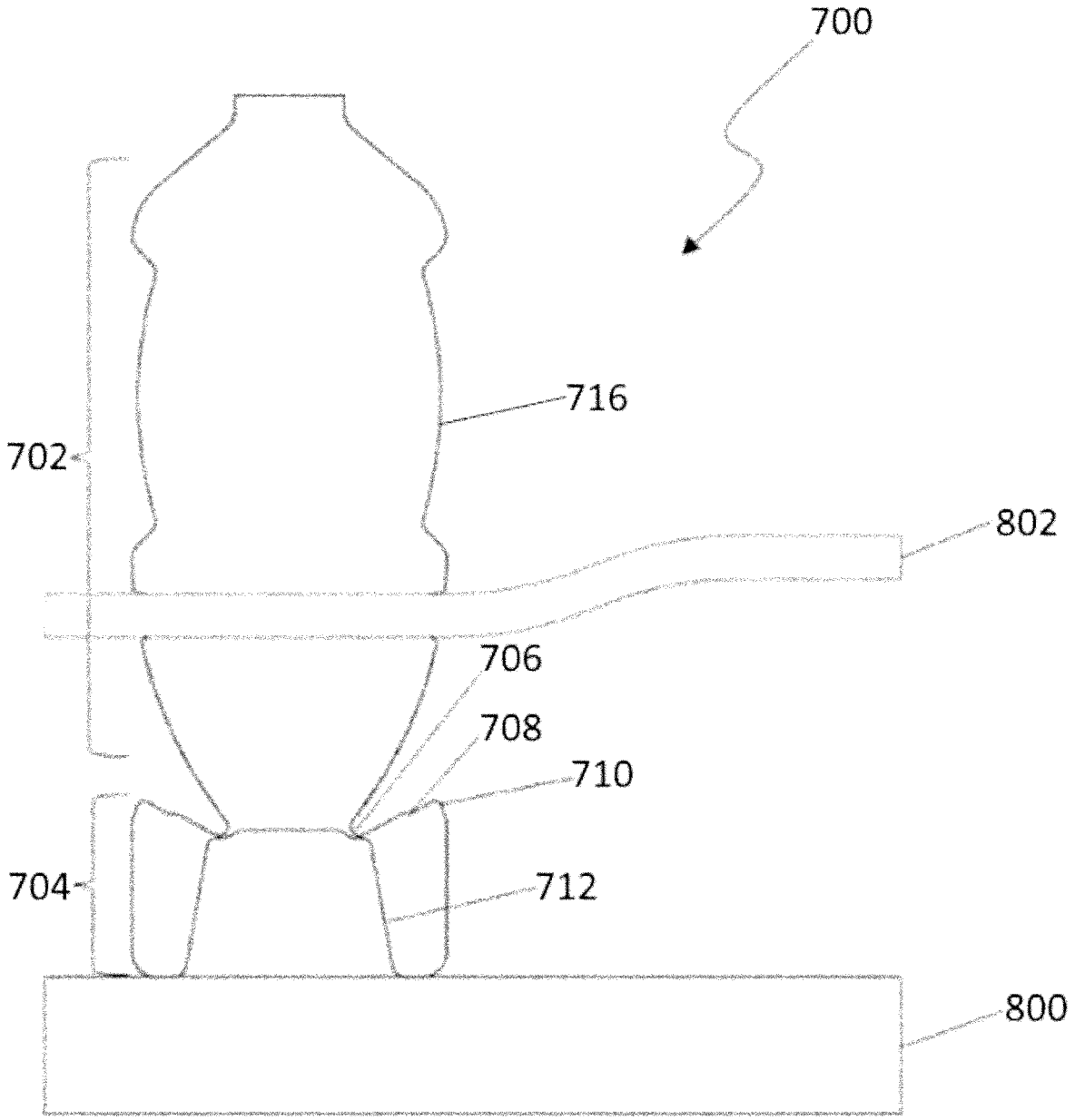
FIG. 8B is a further side view of the specifically configured shelf of 8A with the embodiment of FIG. 7A in an "activated" state.

The guide rails (802) reduced in height relative to the shelf (800) from the front, where the bottle (700) is loaded, to the back of the shelf. Thus, as the bottles are inserted into the shelf and advanced along it, pressure is applied by the guide rails to the recesses (804), such that the bottle is urged into an "activated" state, as shown in FIG. 8B. The resulting vertical displacement, for a 750 mL bottle, could be as little as 15 to 20 mm or as much as 60 mm or more. However, it will be appreciated that this depends on the height of the punt (712).

It can be seen that the pressure applied to the bottle (700) by the guide rails (802) causes deformation of the lines of weakness (708, 710) about the lower compartment (704). The waist portion (706) is brought down into the lower compartment (704) and seals against the punt (712) while the displacement panels (716) "pop" outwards.

It should be appreciated that while the chiller shelf is held at a temperature that is less than 0° C., thus encouraging the development of ice crystals within the lower compartment (704), the remainder of the chiller, in which the upper compartment (702) of the bottle (700) is held, is kept at about 5° C. This keeps the temperature of the contents of the upper compartment to a level that is more comfortable for a consumer following purchase of the bottle from the retailer. This makes the present invention a year-round concept; if being used in winter, the consumer can still apply force to the lower compartment in order to break up any frozen beverage if the liquid portion has already been consumed.

It will be appreciated that the waist portion (706) of the bottle (700) undergoes some stresses due to the transition from the "as moulded" state to the "activated" state. In particular, if sufficient force is applied, there could be some buckling at or about the waist portion which is likely to be the weakest part of the bottle due its reduced circumference relative to the upper and lower compartments.

Figure 9:
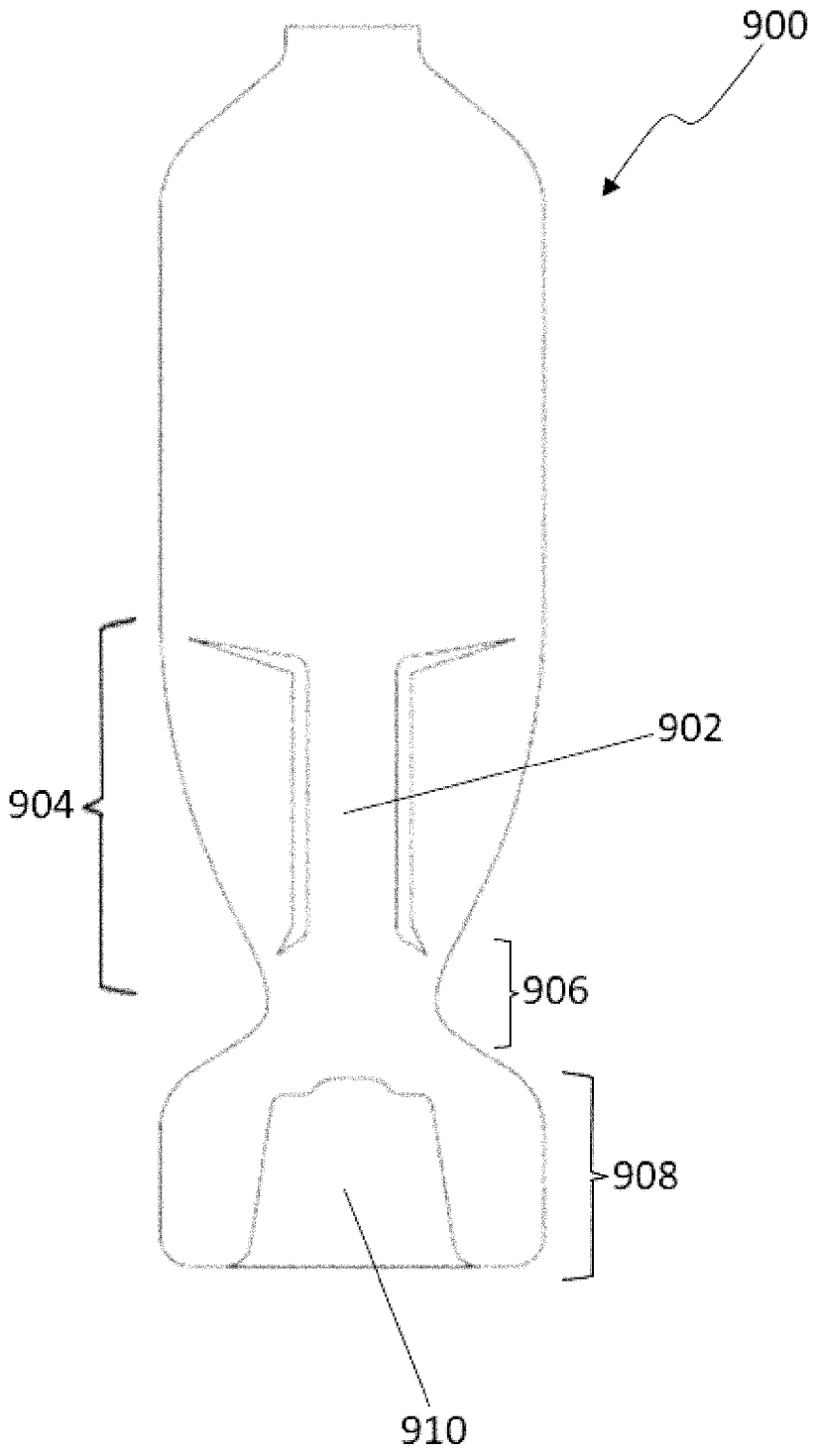
FIG. 9 is a side view of yet another embodiment of the present invention.

In some embodiments, to provide some structural rigidity and control to the waist portion during the transition, the bottle may include some reinforcing structures, an example of which is illustrated in FIG. 9. The illustrated bottle embodiment (900) includes a strengthening beam (902) that runs vertically through the mid-portion (904) of the bottle. This confers some structural integrity to this part of the bottle, helps to prevent or minimise buckling and limits any deformation to the desired points, i.e. hinge lines about the waist (900) lower compartment (908) and/or punt (910).

Figure 10A:
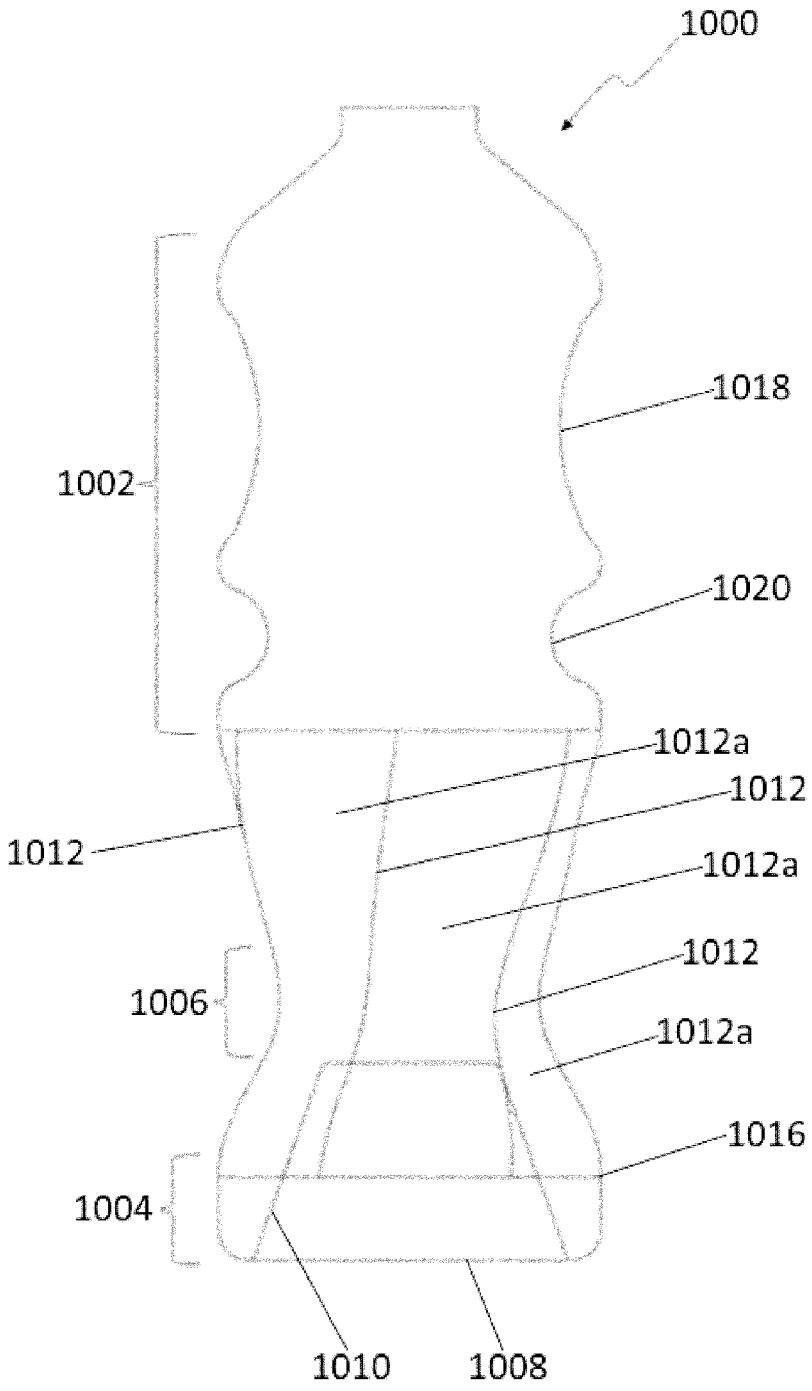
FIG. 10A is a side view of a yet another embodiment of the present invention in an "as moulded" state.
Figure 10B:
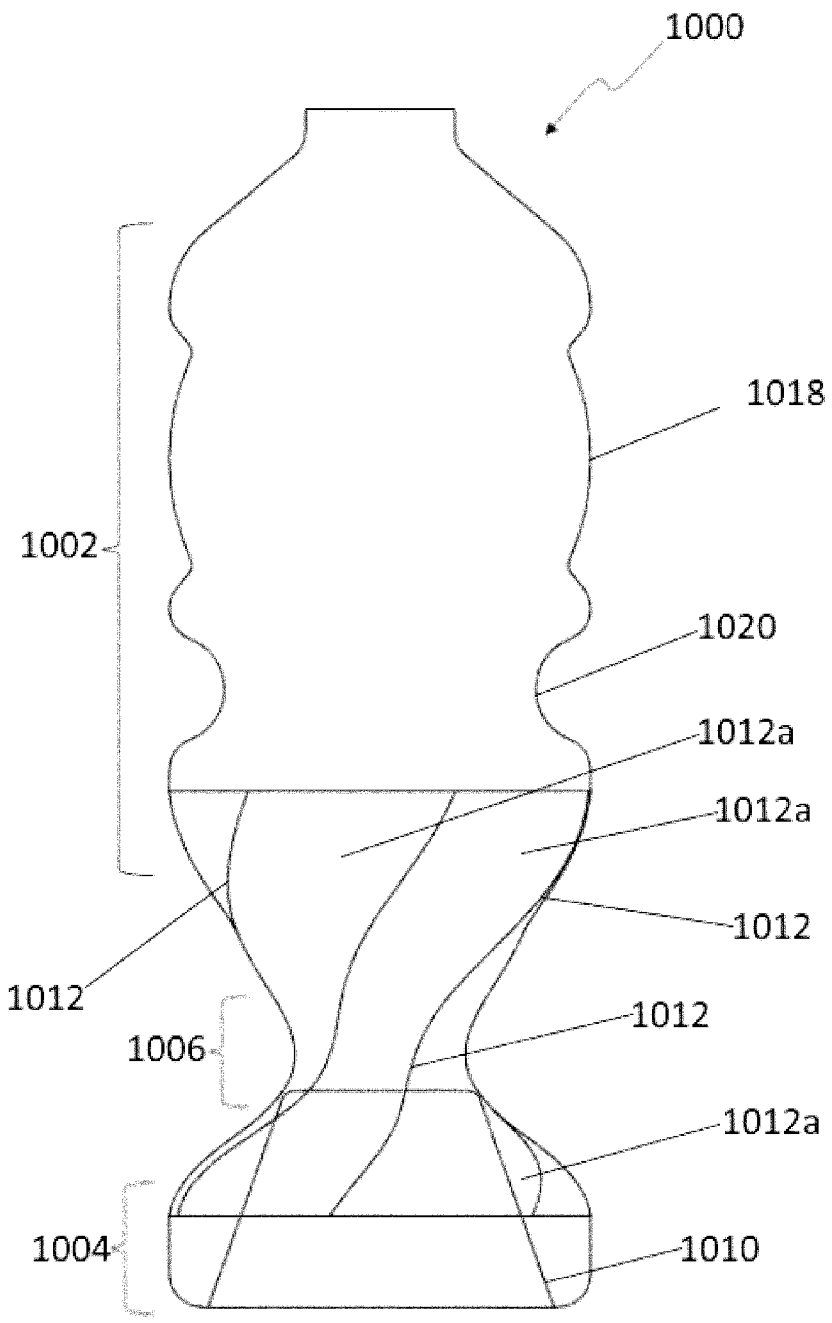
FIG. 10B is a side view of the embodiment of FIG. 10A in an "activated" state.

Another bottle embodiment (1000) is illustrated in FIGS. 10A (in an "as moulded" state) and 10B (in an "activated" state). Consistent with the previous embodiments, the bottle has an upper compartment (1002), a lower compartment (1004) and a reduced waist portion (1006) that serves as a passage between the two compartments. Arising from the base (1008) of the bottle, and intruding into the interior of the lower compartment, is a raised punt (1010).

At least part of the waist portion (1006) and lower compartment (1004) is configured with a plurality of diagonally arranged detail lines (1012) that form a series of panels (1012*a*). Upper (1014) and lower (1016) detail lines are moulded into the bottle to form stiffer regions and to define the ends of the panels.

It will be appreciated that under application of a force, the bottle (1000) will be deformed, in a compressive manner, between the upper (1014) and lower (1016) detail lines. The portions of the bottle outside of these lines will remain substantially unchanged (other than the displacement panels (1018)) during the deformation of the bottle as it moves from an "as moulded" state to an "activated" state. Without these detail lines, there could be undesired deformation of the bottle above the upper detail line and below the lower detail line.

The arrangement of the detail lines (1012) and panels (1012*a*) means that they are configured to act as a spring; when force is applied to the top of the bottle (1000), these are effectively compressed. This acts to bring the waist portion (1006) towards the punt (1010), reducing the passage between the upper (1002) and lower (1004) compartments and limiting transfer of beverage between the two.

As with previous embodiments, displacement panels (1018) are provided in the sides of the upper compartment (1002). These accommodate the displacement of beverage from the lower compartment as its volume is reduced through the movement of the waist portion (1006) relative to the punt (1010) as the bottle (1000) is being transitioned from an "as moulded" state to an "activated" state. They also act to maintain the pinch point or restriction between the waist portion and the punt.

The bottle (1000) also includes grooves (1020) moulded above the upper detail line (1014). As seen from FIGS. 11A to 11C, these grooves interact with the guide rails (1100) of a chiller shelf (1102). Although in this view the grooves are positioned below the displacement panels (1018), this is not meant to be limiting. They could also be located above the displacement panels, closer to the neck of the bottle.

Figure 11A:
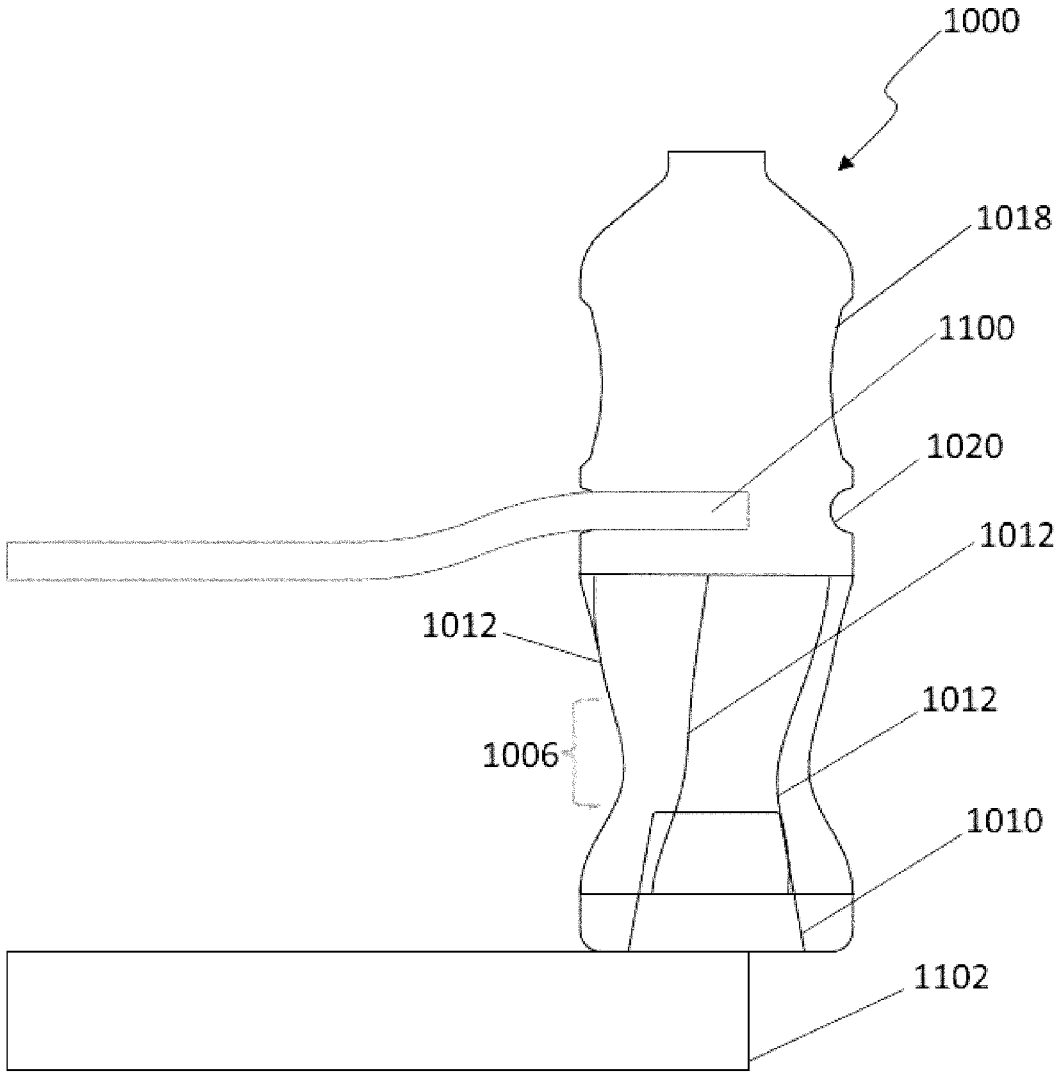
FIG. 11A is a side view of the embodiment of FIG. 10A in a specifically configured shelf at point of sale, prior to being "activated"
Figure 11B:
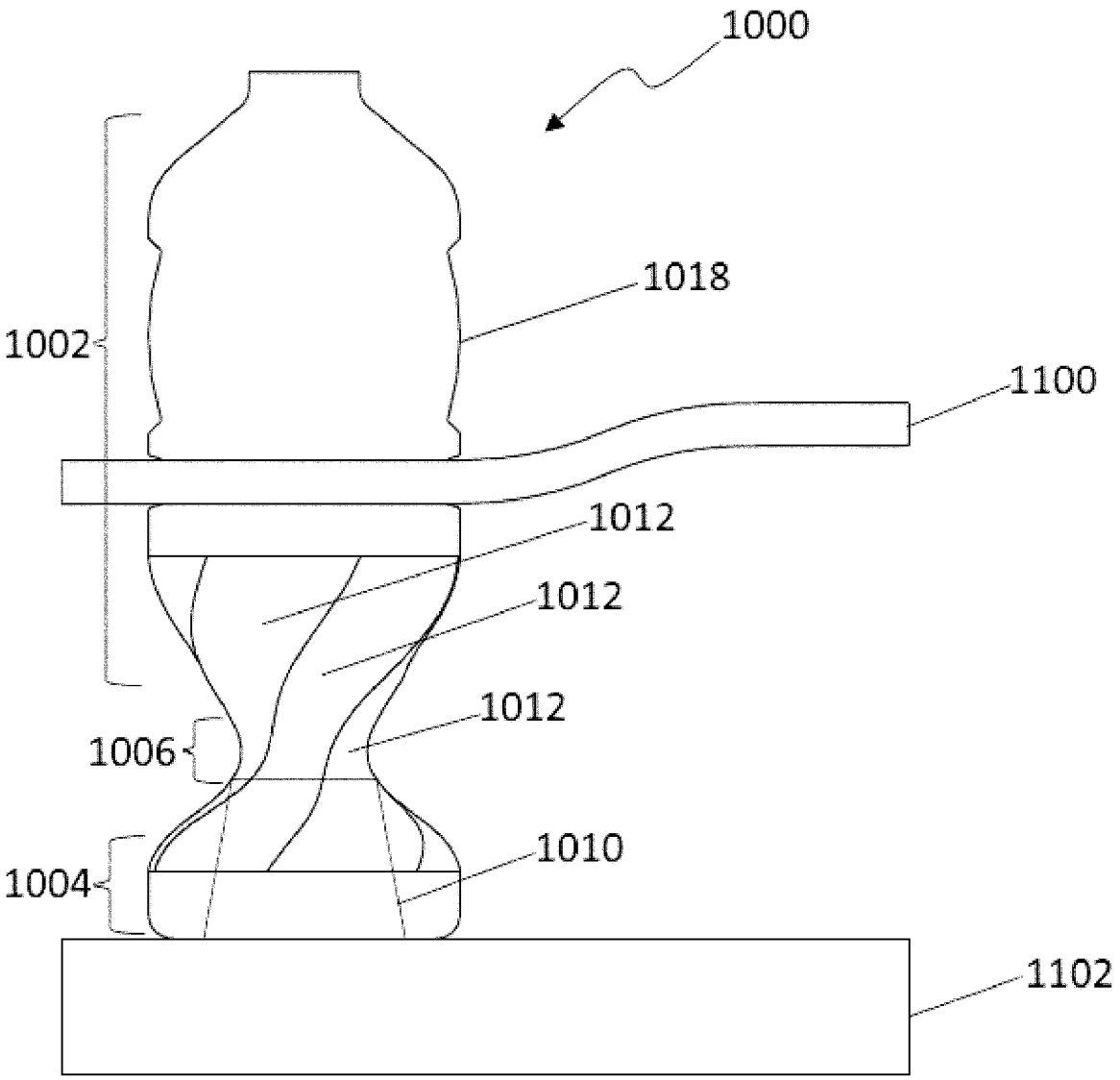
FIG. 11B is a further side view of the specifically configured shelf of FIG. 11A with the embodiment of the invention of FIG. 10A in an "activated" state.
Figure 11C:
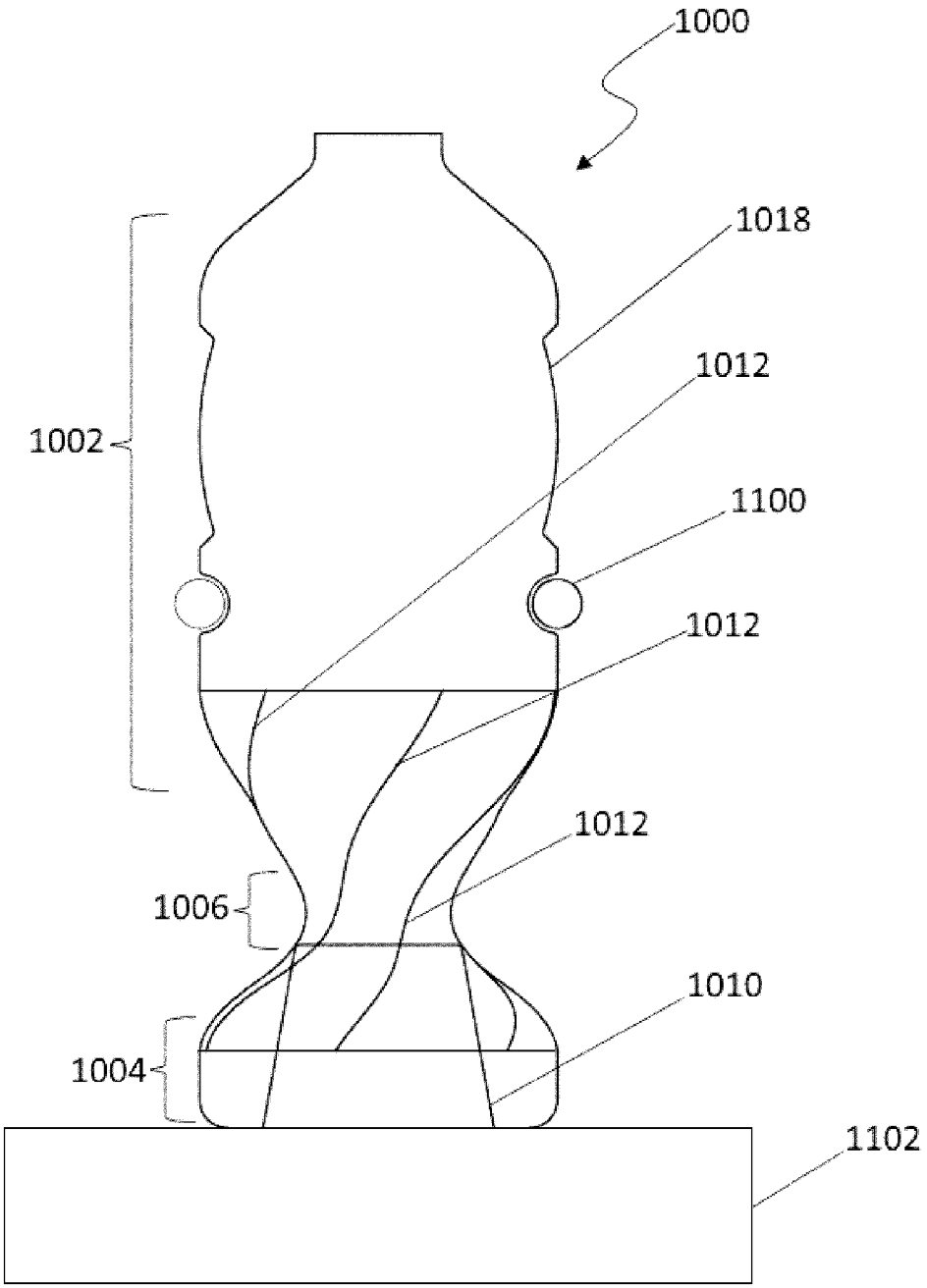
FIG. 11C is a front view of the specifically configured shelf of FIG. 11A with the embodiment of the invention of FIG. 10A in an "activated" state.

FIG. 11A shows the bottle (1000) in its "as moulded" state, being introduced to the shelf (1102), while FIGS. 11B and 11C show the bottle fully inserted, and in an "activated" state.

As the bottle (1000) is advanced along the shelf (1102), the guide rails (1100), which reduce in height from the front of the shelf to its back, apply a downward force to the surface area of the grooves (1020). This force is transferred to the portion of the bottle beneath the grooves.

The placement of the upper and lower detail lines (not shown) limit the deformation of the lower compartment (1004) to the region defined by the panels (1012) which are formed by angled detail lines.

This deformation brings the waist portion (1006) into contact with the punt (1010) sealing the lower compartment (1004) from the upper compartment (1002). This allows the beverage contained within the lower compartment to be frozen while that contained within the upper compartment remains in a liquid form, able to be readily consumed immediately following purchase from the retailer.

When the bottle (1000) is removed from the shelf, the user can simply grip the upper (1002) and lower (1004) compartments and draw them apart from each other to apply a pulling force to fully or partially return the bottle to its "as moulded" state. Alternatively, they may squeeze the displacement panels (1018) together until these "pop" back into a concave state and release the waist portion (1006) from contact with the punt (1010). Either way, this allows the frozen beverage in the lower compartment to come into contact with that of the upper compartment. This can keep the liquid relatively chilled and prolong the cool temperature of the beverage.

The previous bottle embodiments described include displacement panels as part of its walls, shoulder or punt. However, the displacement panels could be integrated into the closure of the bottle and two examples are depicted in FIGS. 12A, 12B and 13A, 13B respectively.

Figure 12A:
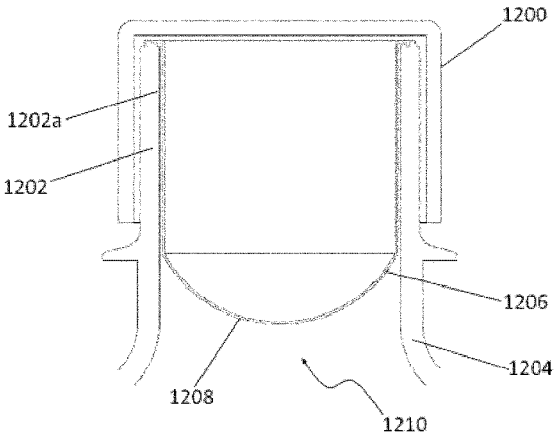
FIG. 12A is a front view of one embodiment of a closure suitable for use for some embodiments of the invention, wherein the closure is in an "as moulded" state.

In FIG. 12A, the closure is a standard cap (1200) which is threaded onto the mouth (1202) of a bottle (1204). The closure also includes a drop-in seal (1206), which lines the interior (1202*a*) of the mouth and has a dome-like structure (1208) extending into the interior (1210) of the bottle when in the "as moulded" state as shown. The dome may be preformed or alternatively the seal itself is made from a relatively flexible material that allows some stretching to create the dome.

Figure 12B:
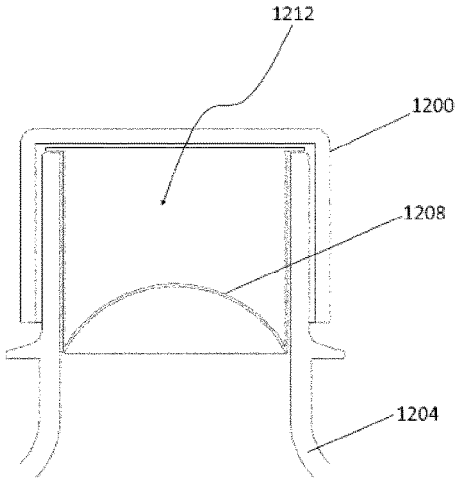
FIG. 12B is a front view of the closure of FIG. 12A in an "activated" state.

To accommodate changes in volume as the bottle (1204) is activated, the dome (1208) reverses its orientation as shown in FIG. 12B. It now protrudes into the interior (1212) of the cap (1200).

It will be appreciated that some displacement of air in the interior will occur as a result of the movement of the dome (1208). To allow this, the cap (1200) may not be tightly screwed on or alternatively provided with one-way escape valves (not shown) thus permitting the air to escape. Apertures may even be provided in the sides of the cap (1200), so long as this does not affect the user's ability to securely fasten the cap to close the bottle (1204). This configuration is particularly preferred for conventional closures since it is relatively cost effective to implement.

Figure 13A:
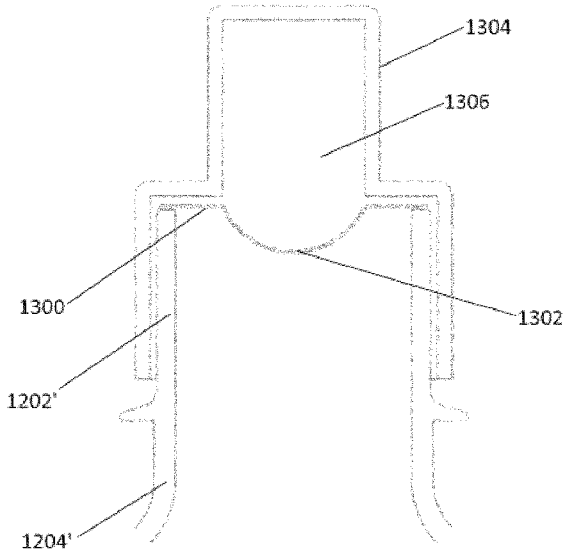
FIG. 13A is a front view of a further embodiment of a closure suitable for use for some embodiments of the invention, wherein the closure is in an "as moulded" state.
Figure 13B:
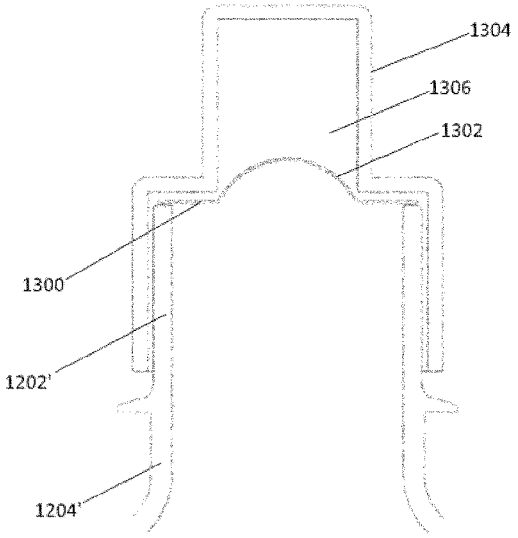
FIG. 13B is a front view of the closure of FIG. 13A in an "activated" state.

A variation is shown in FIG. 13A, but in this instance, the seal (1300) simply spans and sits flat on the opening of the mouth (1202') of the bottle (1204'). When activated, as represented in FIG. 13B, the dome (1302) sits proud of the mouth. This requires a specially configured cap (1304) with sufficient capacity to accommodate the dome and may require the same considerations discussed above in respect of movement of air from within the interior (1306) of the cap. This embodiment may be preferred for sipper-type enclosures.

The arrangements of FIGS. 12A to 13B may also be useful for bottles formed from aluminium, such as is typically used for canned beverages. This means that there is no need to factor in the manufacturing of the displacement panels into the wall or punt of the bottle itself.

Figures 14A, 14B:
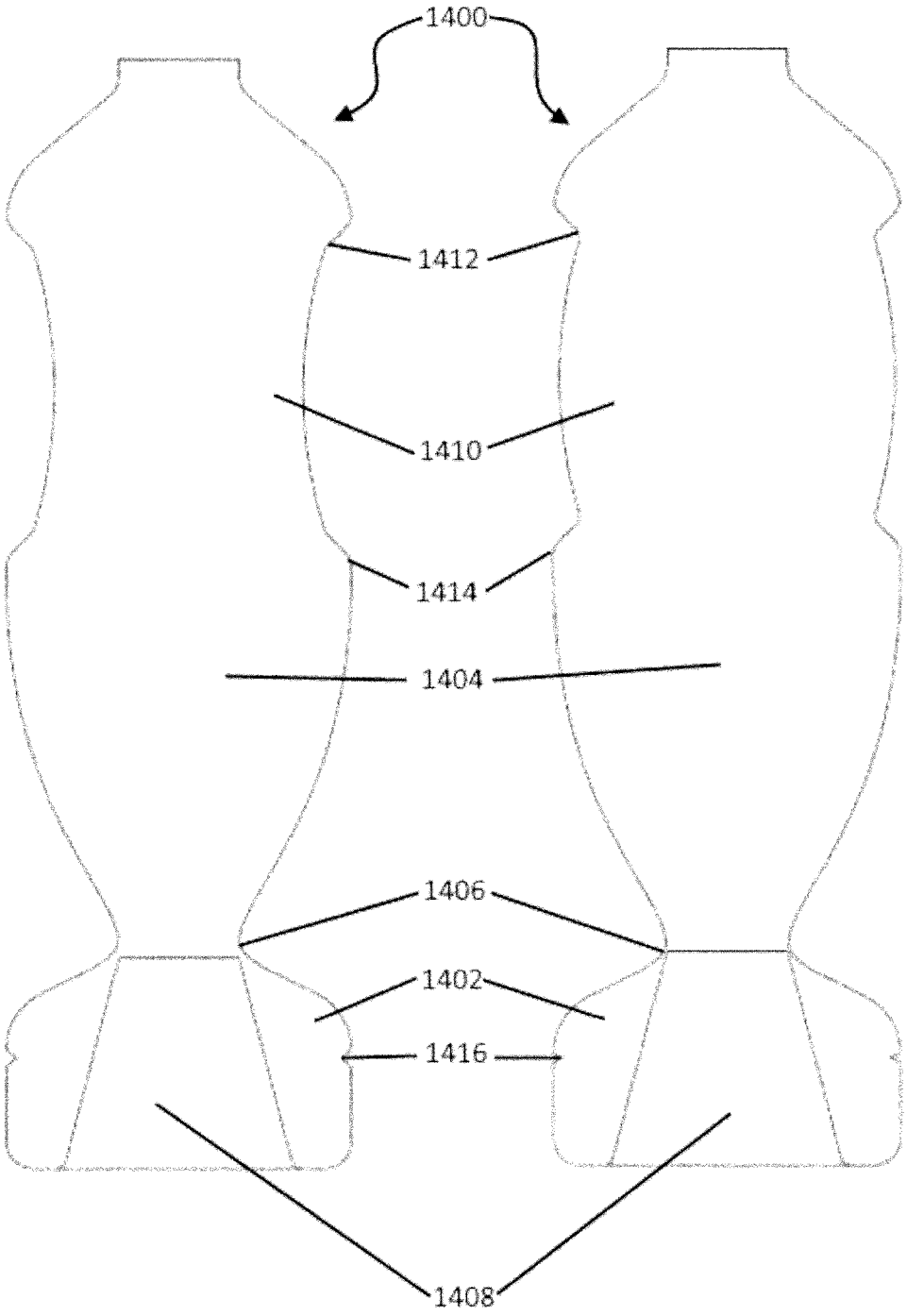
FIG. 14A is a front view of an embodiment of the invention formed from aluminium when in an "as moulded" state.
FIG. 14B is a front view of the embodiment of FIG. 14A when in an "activated" state.

FIGS. 14A and 14B depict an embodiment of the invention (1400) formed from aluminium, in an "as moulded" state and "activated" state respectively. An advantage of using aluminium is that sealing of the lower compartment (1402) from the upper compartment (1404) can be achieved with relatively minimal movement at the waist portion (1406); it can be as little as one or two millimetres. The punt (1408) is also more easily formed during the manufacture process.

The embodiment (1400) shown includes a displacement panel (1410); this is defined by detail lines (1412, 1414) that circumscribe the bottle and defined the upper and lower edges of the displacement panel respectively. However, a further advantage of using aluminium is that due to the minimal displacement of the bottle contents as it moves from the "as moulded" state of FIG. 14A to the "activated" state of FIG. 14B, only a small increase in volume needs to be accommodated. Thus, it should be appreciated that a bottle made of aluminium may not need a displacement panel at all and any increase in volume could be dealt simply by the walls flexing outwards slightly.

In the illustrated embodiment (1400), the deformation of the lower compartment (1402) is achieved via a detail line (1416) circumscribing this area of the bottle and serving as a hinge. This can be compressed together and in doing so, the punt (1408) is advanced to meet and substantially seal at the waist (1406). Although only one detail line is shown here, alternative embodiments may include further detail lines to form a corrugated section to the lower compartment. This arrangement of the lower compartment may also be used for bottles made of plastics material such as PET.

Figures 15A, 15B:
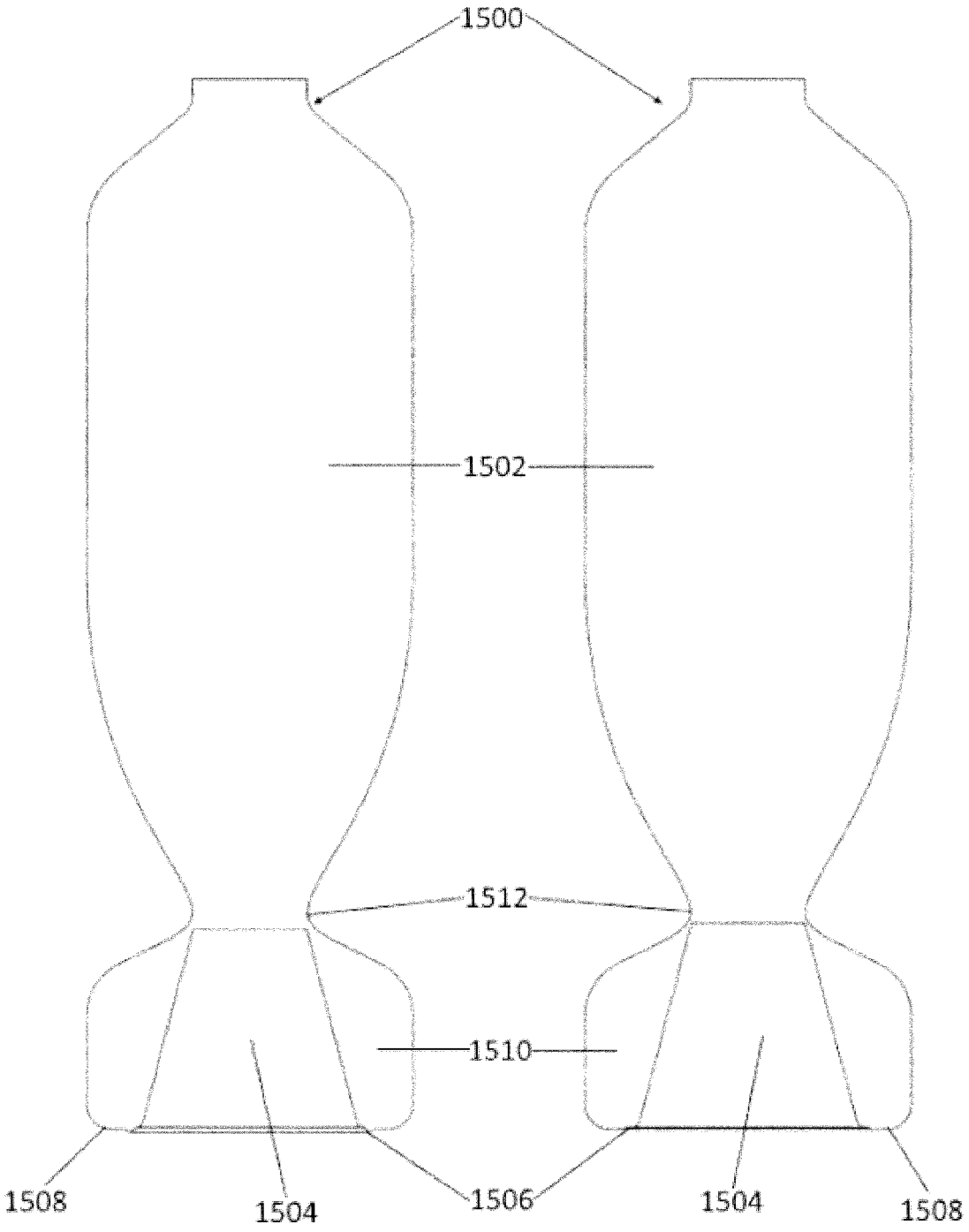
FIG. 15A is a front view of a further embodiment of the invention formed from aluminium when in an "as moulded" state.
FIG. 15B is a front view of the embodiment of FIG. 15A when in an "activated" state.

A further embodiment (1500) is shown in FIGS. 15A and 15B. As with that of FIGS. 14A and 14B, it is formed of aluminium but this time without displacement panels to the upper compartment (1502).

In this case, the punt (1504) of the bottle (1500) is configured with a detail line (1506) where it arises from the base (1508) of the lower compartment (1510). When activated, as shown in FIG. 15B, this serves to advance the punt towards the waist portion (1512) to seal the lower compartment from the upper compartment (1502). The vertical movement of the punt is relatively minimal; the slight increase in volume of the upper compartment as a result of the movement of the bottle's contents from the lower compartment could be accommodated simply through flexing or bulging of the sides of the bottle or the bottle may use a closure arrangement such as that illustrated in FIGS. 12A and 13A to allow for the increase in volume.

The entire disclosures of all applications, patents and publications cited, if any, are herein incorporated by reference.

Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

The invention claimed is:

1. A bottle, wherein the bottle includes:
an upper compartment;
a lower compartment including a base, wherein the base includes a raised punt; and
a waist portion defining a passage between the upper and lower compartments; and
wherein
the waist portion and/or lower compartment is configured to be temporarily deformed upon application of a vertically applied force to bring the raised punt into contact with the waist portion thereby constricting the passage between the upper and lower compartment.

2. The bottle as claimed in claim 1, wherein the bottle has an "as moulded" configuration, before the passage between the upper and lower compartments is constricted, and an "activated" configuration, when the passage between the upper and lower compartments has been constricted.

3. The bottle as claimed in claim 2, wherein the bottle includes at least one displacement panel.

4. The bottle as claimed in claim 3, wherein when the bottle is in an "as moulded" configuration, the displacement panel is relatively concave, and wherein when the bottle is in an "activated" configuration, the displacement panel is relatively convex.

5. The bottle as claimed in claim 2, wherein at least part of the waist portion has a diameter that is reduced relative to diameters of the upper and lower compartments when the bottle is in an "as moulded" state.

6. The bottle as claimed in claim 2, wherein in the "activated" configuration, a pinch point between the punt and the waist portion has been created, thereby sealing or significantly restricting the passage between the upper and lower compartment.

7. The bottle as claimed in claim 2, wherein the raised punt arises from the base of the lower compartment.

8. The bottle as claimed in claim 2, wherein the waist portion is configured to temporarily deform as the bottle transitions from its "as moulded" configuration to its "activated" configuration to bring a surface of the punt into contact with the waist portion of the bottle to constrict the passage between the lower and upper compartments.

9. The bottle as claimed in claim 8, wherein the waist portion includes at least one generally horizontal line of weakness circumscribing the waist portion and configured to act as a living hinge.

10. The bottle as claimed in claim 8, wherein a portion of the lower compartment includes at least one generally horizontal line of weakness circumscribing the lower compartment and configured to act as a living hinge.

11. The bottle as claimed in claim 8, wherein the waist portion includes at least one line of weakness provided as a continuous spiral circumscribing the waist portion.

12. The bottle as claimed in claim 8, wherein the waist portion includes a plurality of diagonally arranged lines of weakness.

13. The bottle as claimed in claim 12, wherein the bottle includes reinforcing structures, which with the plurality of diagonally arranged lines of weakness define a plurality of panels circumscribing the circumference of at least a portion of the waist portion.

14. The bottle as claimed in claim 2, wherein the lower compartment is configured to temporarily deform as the bottle transitions from its "as moulded" configuration to its "activated" configuration to bring a surface of the punt into contact with the waist portion of the bottle to constrict the passage between the lower and upper compartments.

15. The bottle as claimed in claim 14, wherein the punt is a truncated cone arising from the base, wherein the truncated cone has walls and a top surface, and wherein the top surface is substantially flat.

16. The bottle as claimed in claim 14, wherein the top surface of the punt has a diameter approximating the width of the waist portion of the bottle at its narrowest point.

17. The bottle as claimed in claim 15, wherein the punt includes at least one line of weakness configured to act as a living hinge, wherein the line of weakness is where the walls of the punt meet the base of the lower compartment.

18. The bottle as claimed in claim 15, wherein the punt includes at least one line of weakness configured to act as a living hinge, wherein the line of weakness is partway up the walls of the punt.

19. The bottle as claimed in claim 1, wherein the upper compartment includes a mouth for introduction of a beverage.

20. The bottle as claimed in claim 19, wherein the upper compartment is configured with a progressive inward taper towards the mouth.

21. The bottle as claimed in claim 3, wherein the at least one displacement panel includes a perimeter formed by detail lines.

22. The bottle as claimed in claim 21, wherein the detail lines are configured as hinges for the at least one displacement panel.

23. The bottle as claimed in claim 3, wherein the at least one displacement panel is provided to the upper compartment.

24. The bottle as claimed in claim 23, wherein the upper compartment includes two or more displacement panels spaced equidistance about the circumference of the bottle.

25. The bottle as claimed in claim 3, wherein the at least one displacement panel is provided to the lower compartment.

26. The bottle as claimed in claim 25, wherein the at least one displacement panel is provided to the punt of the lower compartment.

27. The bottle as claimed in claim 3, wherein the at least one displacement panel is provided to a closure for the bottle.

28. The bottle as claimed in claim 1, wherein the bottle is moulded from polyethylene terephthalate (PET).

29. The bottle as claimed in claim 1, wherein the bottle is formed from aluminium.

30. A method, comprising:

obtaining a bottle, wherein the bottle includes:

an upper compartment;

a lower compartment, wherein the lower compartment includes a base, wherein the base includes a raised punt; and a waist portion defining a passage between the upper and lower compartments, wherein the lower compartment and/or waist portion is configured to be temporarily deformed upon application of a vertically applied force to bring the raised punt into contact with the waist portion thereby constricting the passage between the lower and upper compartment, wherein the method further includes placing the bottle in a chiller, wherein the chiller includes a freezing shelf with a surface at least partially complementary to a surface of the lower compartment of the bottle, and wherein the lower compartment is deformed through the application of a vertically applied force to bring the raised punt into contact with the waist portion prior to or during the placement of the bottle in the chiller.

* * * * *